US006907215B2

(12) United States Patent
Yasukawa et al.

(10) Patent No.: US 6,907,215 B2
(45) Date of Patent: Jun. 14, 2005

(54) DEVELOPING DEVICE AND IMAGE FORMING APPARATUS INCORPORATING THE SAME

(75) Inventors: Shinji Yasukawa, Nagano (JP); Tomoe Aruga, Nagano (JP); Nobumasa Abe, Nagano (JP); Yujiro Nomura, Nagano (JP); Masanao Kunugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/310,989

(22) Filed: Dec. 6, 2002

(65) Prior Publication Data

US 2003/0113139 A1 Jun. 19, 2003

(30) Foreign Application Priority Data

| | | |
|---|---|---|
| Dec. 7, 2001 | (JP) | P2001-374127 |
| Dec. 7, 2001 | (JP) | P2001-374128 |
| Dec. 7, 2001 | (JP) | P2001-374129 |
| May 2, 2002 | (JP) | P2002-130342 |
| May 2, 2002 | (JP) | P2002-130346 |
| May 17, 2002 | (JP) | P2002-142804 |
| May 17, 2002 | (JP) | P2002-142811 |

(51) Int. Cl.[7] ..... G03G 15/08
(52) U.S. Cl. ..... 399/281; 399/284
(58) Field of Search ..... 399/252, 254, 399/258, 260, 262, 263, 281, 283, 284

(56) References Cited

U.S. PATENT DOCUMENTS

| | | | | |
|---|---|---|---|---|
| 4,240,375 A | | 12/1980 | Terashima | |
| 4,721,982 A | | 1/1988 | Ueda | |
| 5,202,732 A | * | 4/1993 | Yahata | 399/263 |
| 5,708,941 A | | 1/1998 | Koga et al. | |
| 5,995,791 A | * | 11/1999 | Kawasaki | 399/281 |
| 6,163,674 A | * | 12/2000 | Ichikawa et al. | 399/284 |
| 6,524,762 B2 | * | 2/2003 | Tsutsui et al. | 399/281 |
| 2002/0009305 A1 | * | 1/2002 | Uehara | 399/281 |

FOREIGN PATENT DOCUMENTS

| | | | | |
|---|---|---|---|---|
| EP | 0 938 033 A1 | | 8/1999 | |
| JP | 5-158345 | | 6/1993 | |
| JP | 7-44008 | | 2/1995 | |
| JP | 9-101678 | | 4/1997 | |
| JP | 9258551 | | 10/1997 | |
| JP | 11-272076 | | 10/1999 | |
| JP | 2000-227702 | | 8/2000 | |
| JP | 2001-51497 A | | 2/2001 | |
| JP | 2001051496 A | * | 2/2001 | G03G/15/08 |
| JP | 2001205842 A | * | 7/2001 | G03G/15/05 |

OTHER PUBLICATIONS

Japanese Office Action dated Jan. 19, 2005.
Japanese Office Action dated Nov. 5, 2004.

* cited by examiner

*Primary Examiner*—Arthur T. Grimley
*Assistant Examiner*—Ryan Gleitz
(74) *Attorney, Agent, or Firm*—Sughrue Mion, PLLC

(57) ABSTRACT

A carrier carries developer. A regulation member disposed at a lower portion of the carrier to control an amount of the developer carried by the carrier. A first container disposed below the carrier to contain the developer therein. A guiding path guides developer dropped by the regulation member from the carrier, to the first container.

18 Claims, 10 Drawing Sheets

*PRIOR ART*

DEVELOPING DEVICE AND IMAGE FORMING APPARATUS INCORPORATING THE SAME

BACKGROUND OF THE INVENTION

The present invention relates to an image forming apparatus such as a copying machine or a printer, and particularly relates to a developing device for use in a tandem type image forming apparatus, and an image forming apparatus incorporating such a developing device.

As systems for a developing device incorporated in an image forming apparatus, there are known a two-component developing system using toner and carrier in developer, and a one-component developing system using no carrier but only toner in developer. Of the one-component developing system, as a one-component color developing system, there are known a four-cycle rotary developing system in which developing devices for respective colors rotate to intermittently abut against a photoconductor in order to perform development on the photoconductor, and a tandem developing system in which development is carried out on photoconductors for respective colors with developing devices substantially fixed.

FIG. 10 shows an example of a related-art developing device using such a one-component developing system disclosed in Japanese Patent Publication No. 2001-51497A. As shown in FIG. 10, this developing device 200 has an agitator 203 rotating in a direction to supply toner to a supply roller 201 from below. Each of blade members 209 fixed to a forward end of an arm portion 205 of the agitator 203 scoops up toner 207 substantially to the height of the supply roller 201 so as to guide the toner 207. Thus, the toner 207 guided by the blade member 209 of the agitator 203 is supplied onto a toner guide member 211.

In addition, the toner 207 supplied onto the toner guide member 211 is carried on the circumferential surface of the supply roller 201, and transferred to a photoconductor drum 215 through a developing roller 213. Then, a regulation blade 217 abuts against the circumferential surface of the developing roller 213 so as to scrape excess toner from the circumferential surface down to an area 219 under the developing roller 213. In addition, in the related art, the width of the blade member 209 is smaller than the width of the toner guide member 211 and the width of the supply roller 201.

In the example shown in FIG. 10, the position where the regulation blade 217 abuts against the circumferential surface of the developing roller 213 is substantially as high as or lower than the top surface of the received toner 207. Accordingly, the undersurface side of the developing roller 213 is always in contact with the toner 207. Therefore, the function that the regulation blade 217 scrapes excess toner from the developing roller 213 to thereby control the volume of toner to be conveyed to a developing area (the portion where the developing roller 213 and the photoconductor drum 215 face each other) and the function that the regulation blade 217 charges toner properly are blocked.

In addition, in the example shown in FIG. 10, it is necessary to provide a return roller 223 for circulating the toner 207 scraped by the regulation blade 217 toward a toner receiving portion 221 suffering an agitating action. The structure becomes more complicated and the cost increases for the necessity of the return roller 223.

When a member for returning toner to the toner receiving portion such as the return roller 223 is provided, the toner suffers mechanical stress so that the lifetime of the toner is shortened. In addition, according to a system in which a developing device is fixed, such as the tandem system, it is necessary to provide a member such as a discharge roller for accelerating the circulation of toner forcibly in order to accommodate the toner in the toner receiving portion efficiently. That results in degradation of the toner in an early stage.

Thus, fogging or solid density changes caused by the image degradation in an early stage are so conspicuous as to be a significant factor in reduction of image quality. In addition, fogging increases the toner consumption so that the running cost for expandable supplies increases Furthermore, the width of each blade member 209 is smaller than the width of the toner guide member 211 and the width of the supply roller 201. Therefore, on the both side end portions of the toner guide member 211 and the supply roller 201, there are areas where the toner is not delivered from the blade member 209. As a result, in the opposite end portions of the supply roller 201, there is a probability that printing is impossible or printing unevenness is caused by flowing-out of the toner from the inner area.

Further, in the example shown in FIG. 10, the width of the toner guide member 211 is set regardless of the width of the supply roller 201. However, when the width of the toner guide member 211 is larger than the width of the supply roller 201, there is excess toner in the opposite ends of the supply roller 201. This excess toner may cause a print in which the printing density is high in the opposite ends of paper. On the contrary, when the width of the toner guide member 211 is smaller than the width of the supply roller 201, toner cannot be supplied all over the effective width of the supply roller 201. This may cause another problem in terms of the relationship to paper that a print low in density in the opposite ends of the paper is made.

Further, in the example shown in FIG. 10, the top surface of the toner guide member 211 indeed has a portion approaching the circumferential surface of the supply roller 201, but even the portion which is closest to the circumferential surface of the supply roller 201 has a distance therefrom large enough for toner to fall through the gap between the toner guide member 211 and the circumferential surface of the supply roller. Accordingly, the reliability with which the toner is carried on the circumferential surface of the supply roller 201 is low. Thus, in a portion where the toner has fallen out, the toner is carried in patches on the circumferential surface of the supply roller so as to cause printing unevenness in a print.

Further, in the example shown in FIG. 10 even in a mode of low duty printing not required a volume of toner as large as that in a normal printing mode, the agitator 203 rotates in the same manner as in the normal printing mode so as to keep on supplying toner onto the toner guide member 211. Accordingly, the toner supply exceeds the toner consumption. It can be therefore considered that the toner runs over the supply roller 201 so that the toner is conveyed directly to the developing roller.

When such a state occurs, not only does unevenness appear in toner volume on the surface of the developing roller, but the charge condition of the toner is also affected to cause trouble in quality of a print.

SUMMARY OF THE INVENTION

It is therefore an object of the invention to reduce mechanical stress on developer to thereby reduce fogging and density changes of the developer and keep good image quality, so that the running cost for expandable supplies can be reduced.

It is also an object of the invention to provide a developing device in which a sufficient volume of toner can be supplied to the upper portion of a supply roller stably, the circulating performance of toner scraped by a regulation blade is improved, and a uniform volume of toner can be supplied all over the lengthwise range of the supply roller stably.

It is also an object of the invention to provide a developing device in which toner existing on a toner guide member is transferred to a supply roller in just proportion so that the toner exists over the lengthwise range of the supply roller with a uniform density.

It is also an object of the invention to provide a developing device in which toner can be carried on the circumferential surface of a supply roller over its lengthwise range surely and uniformly.

It is also an object of the invention to provide a developing device in which toner supply onto a toner guide member can be suspended temporarily in accordance with necessary when the toner consumption is low, for example, in a low duty printing mode or the like.

It is also an object of the invention to provide an image forming apparatus provided with such a developing device.

In order to achieve the above objects, according to the invention, there is provided a developing device, comprising:

a carrier, which carries developer;

a regulation member, disposed at a lower portion of the carrier to control an amount of the developer carried by the carrier;

a first container, disposed below the carrier to contain the developer therein; and a guiding path, which guides developer dropped by the regulation member from the carrier, to the first container.

Preferably, at least part of the regulation member always situates above a top level surface of the developer contained in the first container.

In such a configuration, it is possible to effectively prevent problems such as blocking of the circulating path where the developer scraped by the regulation member is returned to the first container, blocking of the function that the regulation member scrapes excess toner from the carrier to thereby control the volume of developer to be conveyed to a developing area, or blocking of the function that the regulation member charges developer properly.

Preferably, the developing device further comprises: a supplier, which supplies the developer to the carrier; and a second container, disposed in the vicinity of the supplier to temporarily contain the developer supplied from the first container.

In such configurations, the developer controlled by the regulation member can be recovered in the first container by use of the gravitation or the repose angle of the developer. Thus, stress applied to the developer is eliminated so that the lifetime of the developer can be prolonged. As a result, a stain on the white background of print or a change of density caused by fogging of the developer or lowering of charge quantity of the developer can be reduced so that good image quality can be kept. In addition, the developer consumption is also reduced so that the running cost can be reduced. In addition, the developer can be supplied to a developer carrier effectively.

According to the invention, there is also provided a developing device, comprising:

a carrier, which carries developer;

a supplier, which supplies the developer to the carrier; and a first container, disposed below the carrier to contain the developer therein; and a second container, disposed in the vicinity of the supplier to temporarily contain the developer supplied from the first container.

Preferably, the developing device further comprises a receiver, disposed below the supplier to receive the developer supplied from the first container. The second container is provided as a gap defined between the supplier and the receiver.

Preferably, excess developer remaining on the carrier is scraped off by the supplier and transported to the second container.

Preferably, the carrier faces a lower side of an image carrier on which an image is developed.

In such configurations, the developer is conveyed from the first container to the second container, and the developer is supplied from the second container to the supplier. Accordingly, the developer is supplied smoothly and promptly. In addition, developer left behind after development is conveyed to the second container and used smoothly.

According to the invention, there is also provided a developing device, comprising:

a carrier, which carries developer;

a supplier, which supplies the developer to the carrier;

a transporter, which transports the developer to the supplier; and a receiver, to which the transporter is brought into contact when the transporter transports the developer to the supplier, the receiver disposed below the supplier.

Preferably, the developing device further comprises a first container, disposed below the carrier to contain the developer therein. The transporter is rotatably disposed in the first container such that the developer is transported to the receiver along an inner wall face of the first container.

Here, it is preferable that the supplier is rotatably provided, and a rotation center of the supplier always situates above a top level surface of the developer contained in the first container.

Further, it is preferable that: a portion in the receiver at which the transporter is brought into contact has a first flexibility; and the transporter has a second flexibility which is smaller than the first flexibility.

Preferably, the developing device further comprises a second container, provided as a gap defined between the receiver and the supplier, to temporarily contain the developer transported by the transporter.

Preferably, the transporter is rotatable in a first direction, and the supplier is rotatable in a second direction opposite to the first direction.

Further, it is preferable that: the transporter is rotatably provided; the receiver is angled from a horizontal line by a first angle; and a tangent line between the transporter and the receiver at a portion at which the transporter is first brought into contact with the receiver is angled from a horizontal line by a second angle which is smaller than the first angle.

Further, it is preferable that: the transporter is rotatable in a first direction; and a line connecting a rotation center of the transporter and a portion at which the transporter is first brought into contact with the receiver is angled from a vertical line in the first direction by an angle not less than zero degrees.

In such configurations, not only the developer is supplied to the supplier smoothly and promptly, but also stress on the developer is reduced so that the life of the developer can be prolonged. In addition, the developer can be supplied effectively by setting proper arrangement or rigidity of the receiver and the transporter.

Further, it is preferable that: the transporter has an arm member extended from a rotation center thereof and an elastic fin member provided on a distal end of the arm member to transport the developer situated between the inner wall face of the first container and the fin member, and to be brought into contact with the receiver; a scraper is disposed at a portion in the receiver at which the fin member is brought into contact, and has a leading end for scraping off the developer transported by the fin member; and the fin member has a first width along a rotation axis of the transporter, and the leading end of the scraper has a second width smaller than the first width.

In such a configuration, of the developer conveyed on the full-widthwise surface of the fin member, the developer in a range corresponding to the second width can be surely scraped from the fin member. As a result, there is always a constant volume of developer all over the widthwise range of the leading end of the receiver. Thus, a uniform volume of developer can be supplied to the supplier all over its lengthwise range so that printing can be attained without any variation in developer density in the width direction of a recording medium such as paper.

Here, it is preferable that the supplier is rotatable about a rotation axis, and has a third width along the rotation axis, which is smaller than the second width. In this case, printing can be carried out without any variation in developer density in the width direction of paper.

Preferably, the receiver has a slope portion facing the supplier and angled from a horizontal line by an angle not less than a repose angle of the developer.

In such a configuration, after the developer conveyed by the transporter is scraped by the scraper, the developer slides freely down on the slope portion wholly at a uniform speed. Since the slope portion has a fixed inclination at any point, the advance of the developer to the supplier becomes so uniform that a constant volume of developer can be always supplied to the supply roller stably.

Here, it is preferable that: the receiver has a curved portion continued from a lower end of the slope portion and including a portion abutted against the supplier; and a surface roughness of the slope portion and the curved portion is less than an average diameter of the developer.

In such a configuration, an area whose section is narrowed like a wedge is formed between the curved portion and the supplier. Accordingly, with the advance of the developer, the developer density increases so that the pressure force of the developer on the supplier increases. Thus, the developer becomes easy to be carried on the supplier. In addition, there is no probability that the developer stops due to the irregularities of the surface of the receiver. Thus, the developer is conveyed toward the supplier at a uniform speed all over the surface of the receiver without staying on the receiver.

Preferably, the receiver has side walls at both widthwise ends thereof. In this case, the side walls prevent the developer from being leaked to be conveyed sideways when the developer is conveyed from the scraper to the supplier through the slope portion.

Preferably, the developing device further comprising: a regulation member, disposed at a lower portion of the carrier to control an amount of the developer carried by the carrier; and a guiding path, which guides developer dropped by the regulation member from the carrier, to the first container. The guiding path is angled from a horizontal line by an angle not less than a repose angle of the developer.

In such a configuration, the developer scraped by the regulation member can be introduced into the first container by the above guiding path, stress on the developer is reduced so that the lifetime of the developer can be prolonged.

Further, it is preferable that: the receiver includes a receiving portion for receiving the developer from the transporter, and a storage space continued from the receiving portion for temporarily storing the developer to be delivered to the supplier; the supplier is rotatable about a rotation axis and has a first width along the rotation axis; and an entrance width of the storage space is identical with the first width.

In such a configuration, developer existing over the widthwise range of the storage space in just proportion is carried on the supplier likewise over the widthwise range of the supplier in just proportion. Thus, the developer can be carried on the supplier uniformly over its widthwise range. It is therefore possible to attain a print producing no variation in developer density or no unevenness of printing in the width direction of a recording medium such as paper. Incidentally, it is not limited to the case where both the widths are quite equal to each other, but includes widths in a range where the operation and effect can be obtained.

Preferably, a circularity of the developer is not less than 0.95. More preferably, the circularity of the developer is in a range of 0.95 to 0.97.

Since the developer having such a sphericity is high in fluidity, it is a matter of great technical significance to make the entrance width equal to the first width. With this configuration, the developer can be conveyed toward the supplier uniformly as a whole on the receiver. It is therefore possible to obtain a print with no printing unevenness.

Further, it is preferable that: the supplier is rotatable about a rotation axis and elongated along the rotation axis; and both longitudinal ends of the supplier are sealed to retain the developer inside an effective length of the supplier.

In such a configuration, the developer carried on the both longitudinal ends of the supplier can be prevented from falling to the outside, for example, due to vibration or the like. Accordingly, by use of the whole effective length of the supplier, it is possible to attain printing with no printing unevenness in the opposite ends of a relatively large recording medium such as paper.

Further, it is preferable that: the supplier is rotatable about a rotation axis and elongated along the rotation axis; and a longitudinal width of the supplier has a width of a recording medium on which a developed image is recorded.

In such a configuration, printing is performed on the recording medium with the developer on the supplier in just proportion. It is therefore possible to attain printing with no printing unevenness and without wasting the developer.

Further, it is preferable that: the receiver faces the supplier to define a storage space therebetween for temporarily storing the developer transported by the transporter; and the receiver includes a contact portion abutted onto the supplier so that the gap is narrowed toward the contact portion.

In such a configuration, the storage space is filled with the developer gradually so that the developer is pressed onto the circumferential surface of the supplier. Thus, the developer becomes easy to be carried on the supplier over its longitudinal range surely and uniformly.

Here, it is preferable that a first work function of the supplier is not greater than a second work function of a portion of the receiver defining the storage space.

Further, it is preferable that a first work function of the supplier is not greater than a second work function of the developer.

In such configurations, the charged condition of the developer can be kept proper.

Preferably, the developing device further comprises a shatter, disposed in the vicinity of a receiving portion at which the transporter is brought into contact, which selectively disables the reception of the developer into the receiver.

In such a configuration, continuous conveyance of developer onto the receiver by the transporter conveying the developer can be suspended temporarily by the shutter. Accordingly, it is possible to avoid occurrence of such an undesired state that developer overflows from the storage space so as to run over the supplier and flow directly into the carrier in a mode of low duty printing.

Here, it is preferable that the shutter approaches the receiving portion from thereabove to disable the reception of the developer.

In this case, the shutter makes a linear motion to thereby abut against the receiving portion, so that the developer supply onto the receiver is inhibited by the presence of the shutter.

Alternatively, the shutter may be pivotably supported above the receiving portion, so that the reception of the developer is disabled when the shutter is pivoted downward.

Still alternatively, the shutter is pivotably supported below the receiving portion, so that the reception of the developer is disabled when the shutter is pivoted upward.

Still alternatively, the shutter may be movable between a first position and a second position. Here, the transporter is brought into contact with the receiver at the receiving portion when the shutter is placed at the first position, and the transporter is deformed such that the transporter is not brought into contact with the receiver when the shutter is placed at the second position.

Preferably, the shutter is operated in accordance with a consumption amount of the developer at an image carrier on which an image is developed.

In such a configuration, the shutter is useful when the developer consumption is reduced in a low duty printing mode or the like.

Preferably, the developing device further comprises a sensor which detects an amount of the developer stored in a storage space defined between the receiver and the supplier. The shutter is operated in accordance with the amount of the developer detected by the sensor.

In such a configuration, the developer supply onto the receiver can be controlled in accordance with a real volume of developer staying in the storage space regardless of any one of various printing modes.

According to the invention, there is also provided an image forming apparatus, comprising the above-described developing devices. In this case, excellent image quality can be kept in an image forming apparatus such as a printer.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
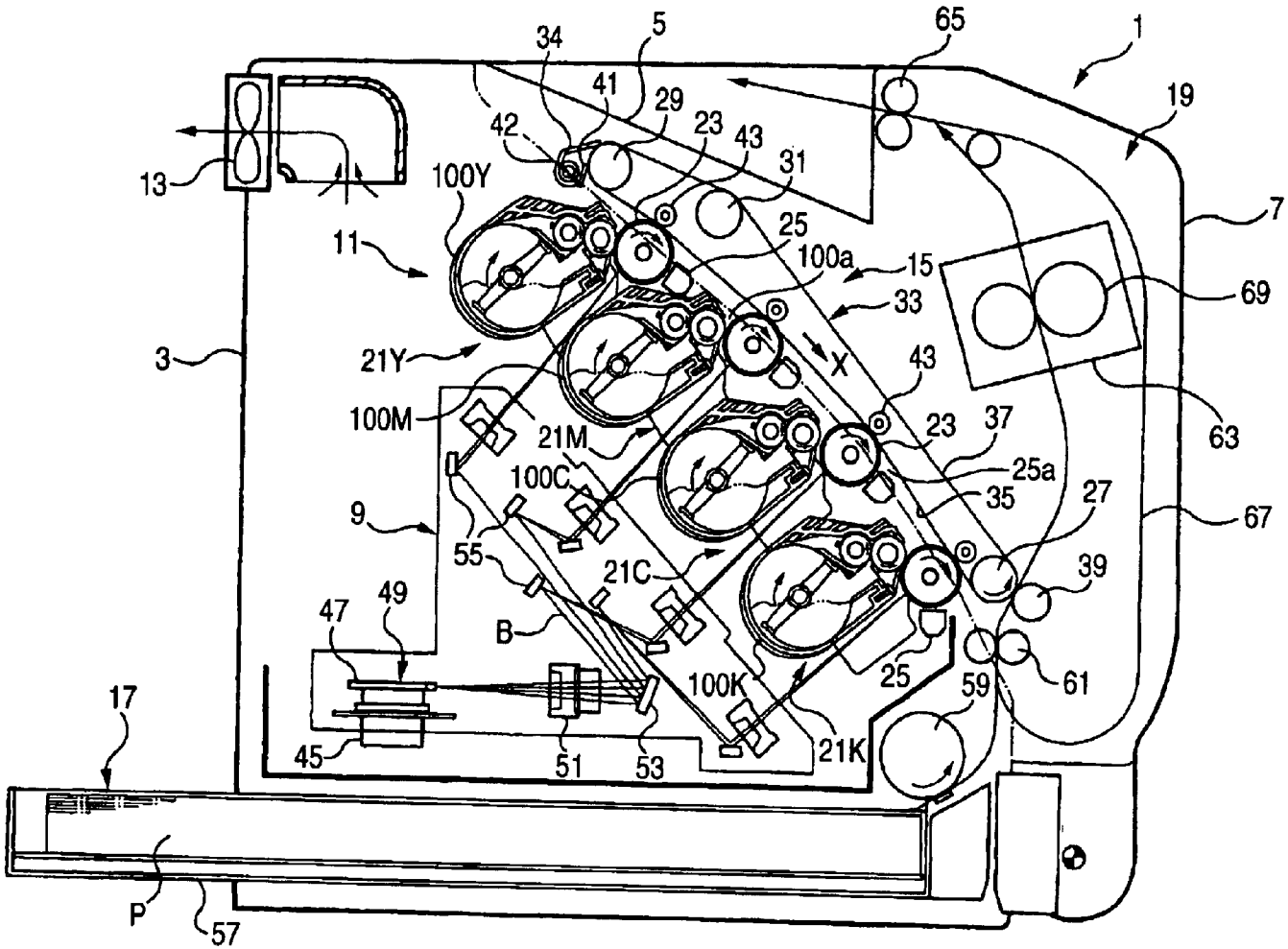
FIG. 1 is a side sectional view showing a tandem type image forming apparatus incorporating developing devices according to the invention.

Preferred embodiments of the invention will be described below with reference to the accompanying drawings. To describe a developing device according to the invention, description will be made first on an example of a tandem type image forming apparatus to which the developing device is incorporated. In FIG. 1, an image forming apparatus 1 has a housing 3, a paper discharge tray 5 and a door body 7. The paper discharge tray 5 is formed above the housing 3. The door body 7 is openably provided in front of the housing. An exposure unit 9, an image forming unit 11, an air fan 13, a transfer belt unit 15 and a paper feeding unit 17 are disposed in the housing 3. A paper conveying unit 19 is disposed in the door body 7.

The image forming unit 11 has four image forming stations 21 in which four developing devices receiving different color toners can be set. Incidentally, the four image forming stations 21 are used for developing devices for yellow, magenta, cyan and black respectively, and these stations are distinguished in FIG. 1 by the reference numerals 21Y, 21M, 21C and 21K respectively. Each of the image forming stations 21Y, 21M, 21C and 21K includes a photoconductor drum 23, a corona charger 25 provided around the photoconductor drum 23, and a developing device 100 according to the invention. Incidentally, the image forming stations Y, M, C and K may be arranged in any order.

The transfer belt unit 15 includes a driving roller 27, a driven roller 29, a tension roller 31, an intermediate transfer belt 33 and a cleaner 34. The driving roller 27 is driven to rotate by a not-shown drive source. The driven roller 29 is disposed obliquely above the driving roller 27. The intermediate transfer belt 33 is laid among the rollers 27, 29 and 31 so as to be driven to circulate in a counterclockwise direction X in FIG. 1. The cleaner 34 abuts against the surface of the intermediate transfer belt 33. The driven roller 29, the tension roller 31 and the intermediate transfer belt 33 are disposed in parallel so as to be inclined with respect to the driving roller 27. Thus, when the intermediate transfer belt 33 is driven, a belt surface 35 in which the belt conveying direction X looks downward is located on the lower side, while a belt surface 37 in which the conveying direction looks upward is located on the upper side.

The photoconductor drums 23 are brought into pressure contact with the belt surface 35 along an arched line, so as to be driven to rotate in the directions shown by the arrows in FIG. 1, respectively. The tension of the intermediate transfer belt 33, the curvature of the arched line, and so on, can be controlled by adjusting the position of the tension roller 31.

Incidentally, the intermediate transfer belt 33 may be disposed in a direction inclined to the right in FIG. 1 with respect to the driving roller 27. In accordance with the disposition of the intermediate transfer belt 33, each of the image forming stations Y, M, C and K may be disposed along an oblique arched line in a direction inclined to the right in FIG. 1 with respect to the driving roller 27, that is, symmetrically to those in this figure.

The driving roller 27 also has a function as a backup roller for a secondary transfer roller 39. A rubber layer which has, for example, a thickness of about 3 mm and a volume resistivity of not higher than $10^5$ Ω·cm is formed in the circumferential surface of the driving roller 27, and grounded through a metal shaft. Thus, the rubber layer is formed as a conductive path for secondary transfer bias supplied through the secondary transfer roller 39. In addition, the diameter of the driving roller 27 is made smaller than the diameter of the driven roller 29 and the diameter of the tension roller 31. Thus, recording paper can be easily released by the elastic force of the recording paper per se after secondary transfer. The driven roller 29 also serves as a backup roller for the cleaner 34.

Since the rubber layer having high friction and high shock absorption is provided in the driving roller 27 in such a manner, impact generated when a recording medium enters the secondary transfer portion is hard to transmit to the intermediate transfer belt 33 so that the image quality can be prevented from being deteriorated. In addition, when the diameter of the driving roller 27 is made smaller than the diameter of the driven roller 29 and the diameter of the tension roller 31, recording paper can be released easily by the elastic force of the recording paper per se after secondary transfer.

The cleaner 34 is provided on the side of the belt surface 35 having a downward conveying direction. The cleaner 34 has a cleaning blade 41 for removing toner staying on the surface of the intermediate transfer belt 33 after secondary transfer, and a toner conveying path 42 for conveying the recovered toner. The cleaning blade 41 abuts against the intermediate transfer belt 33 in the portion where the intermediate transfer belt 33 is wound on the driven roller 29. In addition, primary transfer members 43 abut against the back surface of the intermediate transfer belt 33 so as to face the photoconductor drums 23 of the image forming stations 21Y, 21M, 21C and 21K. A transfer bias is applied to the primary transfer members 43.

The exposure unit 9 is disposed in a space formed obliquely under the image forming unit 11. The air fan 13 is disposed obliquely above the exposure unit 9. The paper feeding unit 17 is disposed under the exposure unit 9. A scanner 49 constituted by a polygon mirror motor 45 and a polygon mirror 47 is disposed vertically in the bottom portion of the exposure unit 9. In addition, a single f-θ lens 51 and a reflecting mirror 53 are disposed in an optical path B. Further, a plurality of turning mirrors 55 are disposed above the reflecting mirror 53 so as to make scanning optical paths for the respective colors turn back to the photoconductor drums 23, respectively, in no parallel with one another.

In the exposure unit 9, image signals corresponding to the respective colors are emitted from the polygon mirror 47 in the form of laser beams modulated on the basis of a common data clock frequency. The photoconductor drums 23 of the image forming stations 21Y, 21M, 21C and 21K are irradiated with the laser beams passing through the f-θ lens 51, the reflecting mirror 53 and the turning mirrors 55 so that latent images are formed on the photoconductor drums 23, respectively. The length of optical path between the polygon mirror 47 of the exposure unit 9 and the photoconductor drum 23 for one image forming station 21 is set to be substantially equal to that for another image forming station 21.

Accordingly, the scanning width of the optical beam scanned in one optical path becomes substantially equal to that in another optical path. It is therefore unnecessary to provide a special configuration for forming image signals. Thus, laser light sources can form modulated signals based on the common data clock frequency though the signals are modulated with different image signals correspondingly to different color images. Color shift caused by a relative difference in the subscanning direction is prevented because the common reflecting surface is used. It is therefore possible to arrange a color image forming apparatus which is simple in structure and low in cost.

Further, since the polygon mirror motor 45 and the polygon mirror 47 are disposed horizontally in such a manner, force acting on the axial direction of the bearing can be eliminated. Accordingly, even if the number of revolutions increases with the increase in speed and resolution of the image forming apparatus so that the load on the bearing increases, heating in the bearing portion can be reduced. Thus, the change of temperature in the apparatus is reduced so that it is possible to provide an image forming apparatus having a high image quality.

In addition, the turning mirrors 55 are provided to bend the scanning optical paths y, m, c and k so that the height of the casing can be reduced Thus, the apparatus can be made compact. Incidentally, the turning mirrors 55 are disposed to make the scanning optical path lengths of the respective image forming stations Y, M, C and K to the photoconductive drum 23 identical to one another.

In addition, since the vibration of the scanning optics caused by the vibration given to frames supporting the apparatus from the driving system for the image forming unit can be minimized when the scanning optics is disposed in the lower portion of the apparatus, the image quality can be prevented from being deteriorated. Particularly, when the scanner 49 is disposed in the bottom portion of the housing 3, the vibration given to the casing as a whole from the polygon mirror motor 45 itself can be minimized so that the image quality can be prevented from being deteriorated. In addition, when the number of polygon mirror motors 45 as vibration sources is set at one, the vibration given to the casing as a whole can be minimized.

The air fan 13 serves as a cooler. The air fan 13 introduces the air in the arrow direction in FIG. 1 so as to release the heat from the exposure unit 9 and other heat generating members. Thus, the temperature rise of the polygon mirror motor 45 is suppressed so that the image quality can be prevented from being deteriorated while the life of the polygon mirror motor 45 can be prolonged.

In this embodiment, the respective image forming stations Y, M, C and K are disposed obliquely, and the photoconductor drums 23 are arranged upward in parallel and along an oblique arched line so as to be brought into pressure contact with the belt surface 35 of the intermediate transfer belt 33 having a downward conveying direction. Because of such a positioning relationship, the toner container housings 26 are disposed to be inclined obliquely downward.

The paper feeding unit 17 has a paper feed cassette 57 and a pickup roller 59. In the paper feed cassette 57, a stack of recording media P are retained. The recording media P are fed one by one from the paper feed cassette 57 by the pickup roller 59. The paper conveying unit 19 has a pair of gate rollers 61, a secondary transfer roller 39, a fixer 63, a pair of paper discharge rollers 65, and a double-sided print conveying path 67. The pair of gate rollers 61 define the paper feed timing of the recording media P to the secondary transfer portion. The secondary transfer roller 39 is brought into pressure contact with the driving roller 27 and the intermediate transfer belt 33.

The fixer 63 has a pair of rotatable fixing rollers 69, and a pressure applier. At least one of the fixing rollers 69 includes a heating member such as a halogen heater. The pressure applier applies pressure to at least one of the fixing rollers 69 so as to urge it toward the other fixing roller, so that a secondary image secondary-transferred to a sheet material is pressed onto the recording medium P. The secondary image secondary-transferred to the recording medium is fixed on the recording medium at a predetermined temperature in a nip portion formed by the pair of fixing rollers 69.

In this embodiment, the fixer 63 can be disposed in a space formed obliquely above the belt surface 37 of the intermediate transfer belt 33 having an upward conveying direction, that is, in a space opposite to the image forming stations with respect to the transfer belt. Thus, heat transfer to the exposure unit 9, the intermediate transfer belt 33 and the image forming unit 11 can be reduced so that the frequency with which the operation of correcting color shift is carried out for the respective colors can be reduced. Particularly, the exposure unit 9 is placed farthest from the fixer 63 so that the displacement of components of the scanning optics by heat can be minimized. Thus, color shift can be prevented.

In this embodiment, the intermediate transfer belt 33 is disposed in a direction inclined with respect to the driving roller 27. Accordingly, there appears a wide space on the right side in FIG. 1. The fixer 63 is disposed in the space. The developing rollers 107 and the photoconductor drums 23 are rotated to move upward in the same direction. Thus, the apparatus can be made compact. In addition, the heat generated in the fixer 63 can be prevented from being transferred to the exposure unit 9, the intermediate transfer belt 33 and the respective image forming stations Y, M, C and K located on the left side. In addition, the exposure unit 9 can be disposed in a lower space on the left side of the image forming unit 11. Accordingly, the vibration of the scanning optics of the exposure unit 9 caused by the vibration given to the housing 3 from the driving system of the image forming means can be suppressed to a minimum. It is therefore possible to prevent the image quality from being deteriorated.

In addition, in this embodiment, spherical toner is used to enhance the primary transfer efficiency (approximately 100%). Thus, in each of the photoconductor drums 23, there is installed no cleaning unit for recovering toner left behind after the primary transfer. As a result, the photoconductor drums 23 constituted by photoconductor drums each having a diameter of 30 mm or smaller can be disposed closely to one another so that the apparatus can be miniaturized.

In addition, as there is no cleaning unit installed, the corona charger 25 is adopted. When the charger 25 were provided as a charging roller, a slight amount of toner left behind on the photoconductive drum 23 after the primary transfer would be deposited on the roller to thereby result in a failure in charge. However, toner is hard to adhere to the corona charger 25 which is a non-contact charging unit. It is therefore possible to prevent occurrence of a failure in charge.

The developing devices 100 according to the invention are set in the image forming stations 21Y, 21M, 21C and 21K, respectively, in use. Incidentally, in FIG. 1, the developing devices for the respective colors are distinguished by the reference numerals 100Y, 100M, 100C and 100K corresponding to the colors of toners for the developing devices in the same manner as in the image forming stations, respectively. These developing devices have the same configuration fundamentally. Therefore, description will be made below on the configuration of one of them with reference to FIG. 2.

Figure 2:
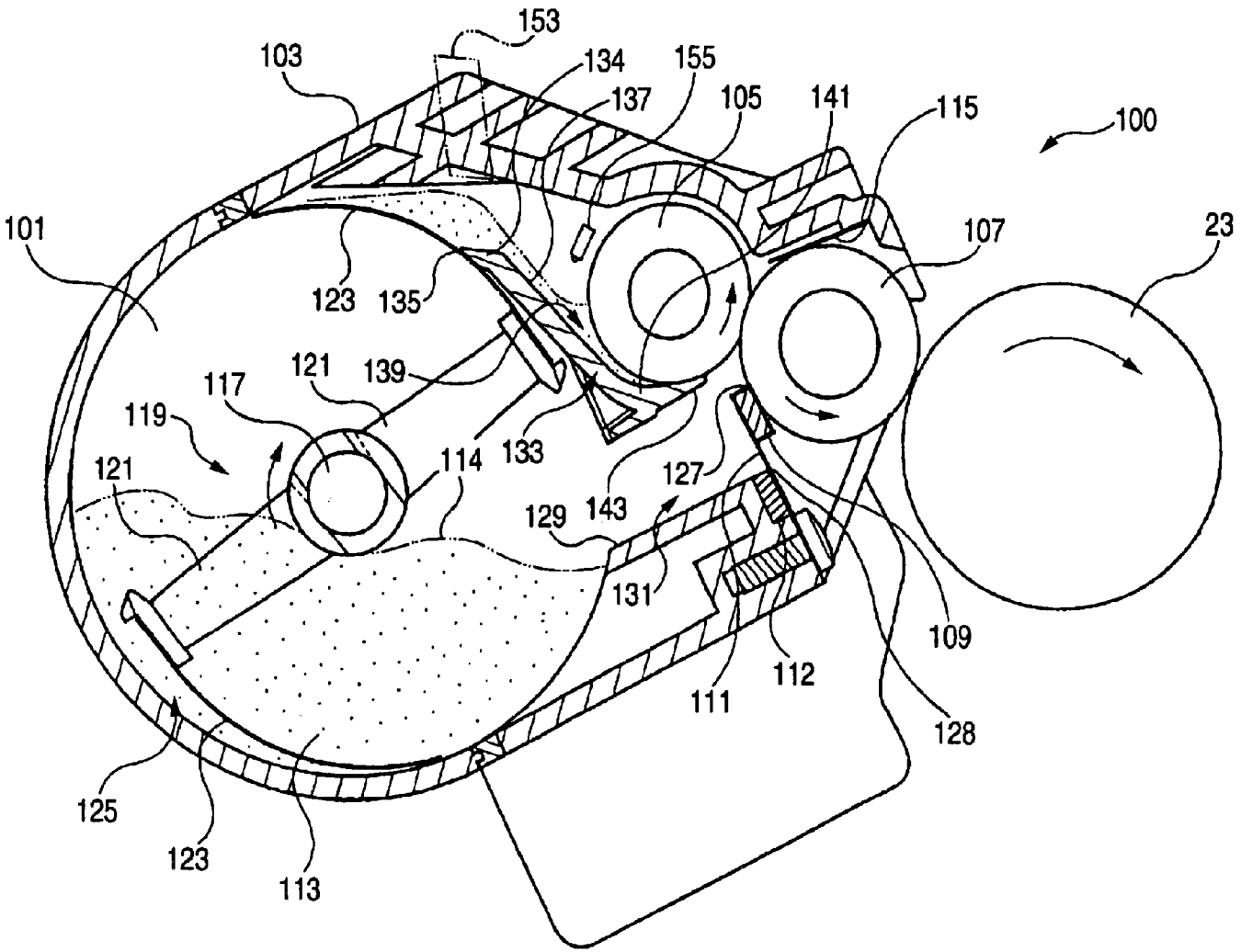
FIG. 2 is a side sectional view of a developing device according to a first embodiment of the invention.

FIG. 2 is a sectional view of the developing device 100. The developing device 100 has a housing 103 in which a substantially cylindrical toner container 101 has been formed. A supply roller 105 and a developing roller 107 are provided for the housing 103. When the developing device 100 is set in an image forming station as shown in FIG. 1, the developing roller 107 is adjacent to the photoconductor drum 23 at a slight distance (for example, 100–300 $\mu$m). While the developing roller 107 is driven to rotate in a direction reverse to the rotation direction (see the arrow in FIG. 2) of the photoconductor drum 23, a latent image formed on the photoconductor drum 23 is developed with toner supplied to the circumferential surface of the developing roller 107. Such a developing operation is performed as follow. That is, a developing bias in which an AC voltage is superimposed on a DC voltage is applied from a developing bias source (not shown) to the developing roller 107 so as to make an oscillating voltage act between the developing roller and the photoconductor drum. Thus, toner is supplied from the developing roller 107 to an electrostatic latent image portion formed in the photoconductor drum 23, so as to perform development. Incidentally, development may be performed with the developing roller 107 in contact with the circumferential surface of the photoconductor drum 23.

The surface of the supply roller 105 is formed out of urethane sponge. The supply roller 105 can rotate in the same direction (counterclockwise direction in FIG. 2) as the developing roller 107 in the state where the circumferential surface of the supply roller 105 is in contact with the developing roller 107. A voltage equal to the developing bias applied to the developing roller 107 is applied to the supply roller 105.

A regulation blade 109 is always brought into pressure contact with the developing roller 107 uniformly all over the lengthwise range of the circumferential surface of the developing roller 107 by the action of a plate spring member 111 and an elastic member 112 provided on the lower side of the plate spring member 111. Thus, the regulation blade 109 scrapes excess toner of the toner adhering to the circumferential surface of the developing roller 107 so that a constant volume of toner is carried on the circumferential surface of the developing roller 107. In addition, the regulation blade 109 also charges toner 113 properly.

The scraped toner falls freely to be mixed into the toner 113 in the toner container 101. This point will be described in detail later. In addition, a seal member 115 is provided so that one end thereof is fixed to the housing 103 while the other end thereof is brought into pressure contact with the upper side of the circumferential surface of the developing roller 107. Thus, the toner 113 in the housing 103 is prevented from flying to the outside.

An agitator 119 is provided in the toner container 101 so as to rotate clockwise in FIG. 2 around a rotating shaft 117. The agitator 119 has two arm members 121 extending in directions reverse to each other with the rotating shaft 117 serving as a rotation center. The arm members 121 are set to be a slight shorter than the diameter of the circle in section of the toner container 101. An agitating fin 123 extends from the forward end of each of the arm members 121 in a direction reverse to the rotation direction of the agitator 119. The agitating fin 123 is made of a sheet member having flexibility. The elastic force caused by the flexibility brings the forward end side of the agitator fin 123 into pressure contact with the inner circumferential surface of the cylindrical toner container 101. With such a configuration, when the agitator 119 rotates, the toner 113 in an area 125 between the inner circumferential surface of the toner container 101 and corresponding one of the agitating fins 123 is scooped up with the agitating fin 123 so that the scooped toner 113 can be conveyed onto a toner guide member which will be described later.

A top surface 114 of the toner 113 received in the toner container 101 is set to be lower than a place 127 where the regulation blade 109 abuts against the circumferential surface of the developing roller 107. This setting is done for the following reason. That is, if the toner volume were large enough to bury the regulation blade 109, the toner scraped by the regulation blade 109 would be close to the regulation blade so that the circulating path for returning the toner into the toner container 101 would be blocked. In addition, the function of that the regulation blade 109 scrapes excess toner from the developing roller 107 to thereby control the volume of toner to be conveyed to a developing area and the function that the regulation blade 109 charges toner properly would be blocked.

More specifically, in this embodiment, the top surface 114 of the toner 113 received in the toner container 101 is set to be lower than the lower end of the regulation blade 109, and the upper limit of the position of the top surface 114 is placed on the position of an intersecting point 128 between the plate spring member 111 and the elastic member 112. If the top surface 114 of the toner 113 in the toner container 101 were located above the intersecting point 128, the motion of the plate spring member 111 might be put under restraint. Thus, there might be a probability that a proper control pressure could not be obtained. As a result, "function of carrying a constant volume of toner on the circumferential surface of the developing roller 107" or the "function of charging the toner properly" might be blocked. However, as described above, when the upper limit of the position of the top surface 114 of the toner 113 is placed on the position of the intersecting point 128, it is possible to eliminate the probability that the respective functions are blocked.

Between the place 127 where the regulation blade 109 abuts against the circumferential surface of the developing roller 107 and the top surface 114 of the toner 113 received in the toner container 101, a toner guide surface 129 is formed as a part of the housing 103. The toner guide surface 129 is inclined obliquely to the top surface 114 of the toner at an inclination angle not smaller than the repose angle of the toner 113. The toner guide surface 129 has a function of guiding the toner 113 scraped from the circumferential surface of the developing roller 107 by the regulation blade 109 into the toner container 101.

The toner 113 scraped from the circumferential surface of the developing roller 107 by the regulation blade 109 does not have to be always guided into the toner container 101 by the toner guide surface 129. The scraped toner 113 may be designed to fall into the toner container 101 directly. In such a manner, a toner guide space 131 in which the toner 113 scraped from the circumferential surface of the developing roller 107 by the regulation blade 109 is introduced into the toner container 101 is formed under the place 127 where the regulation blade 109 abuts against the circumferential surface of the developing roller 107.

A toner guide member 133 is provided above the toner container 101. The toner guide member 133 has a scraper 135, a flat conveying portion 137, a curved portion 141 and a contact portion 143. The scraper 135 is provided in an end portion 134 more distant from the supply roller 105 and formed to be acute enough to scrape the toner 113 conveyed by the agitating fins 123. The top surface side of the flat conveying portion 137 is formed to be flat and inclined at an angle not smaller than the repose angle of the toner 113 toward the supply roller 105 rather than toward the scraper 135. The curved portion 141 is formed on the downstream side of the flat conveying portion 137 so as to be curved to form a concave surface on its upper side. The contact portion 143 is formed on the downstream side of the curved portion 141 so as to abut against the circumferential surface of the supply roller 105 with a linear pressure set properly. The toner guide member 133 is formed so that the surface roughness of the toner guide member 133 including the flat conveying portion 137, the curved portion 141 and the contact portion 143 is lower than the average particle size of the toner.

In addition, by the presence of the contact portion 143, the toner 113 adhering to the under-side surface of the supply roller 105 falls by gravitation so that the volume of toner which can be supplied to the developing roller can be prevented from being reduced. Thus, the image density can be prevented from being lowered. In addition, a temporal toner storage 139 whose section is narrowed like a wedge is formed between the curved portion 141 and the circumferential surface of the supply roller 105. Here, the phrase "section is narrowed like a wedge" means that the section on the entrance side is relatively wide while the section is narrowed as it goes in the traveling direction of the toner, and the section on the tip side of the wedge becomes narrow enough for the toner not to fall freely.

In the toner guide member 133 shaped thus, the toner 113 conveyed by the agitating fins 123 is scraped by the scraper 135. After that, the scraped toner 113 falls by gravitation along the flat conveying portion 137 at a uniform speed all over its widthwise range and at any place of its inclination-direction range so that the toner is once stored in the temporal toner storage 139. In the temporal toner storage 139 narrowed like a wedge, with the advance of the toner 113 to the narrower area, the pressure contact force against the circumferential surface of the supply roller 105 increases gradually so that the toner 113 is pressed onto the circumferential surface of the supply roller 105. Thus, it becomes easier to carry the toner 113 on the circumferential surface. Incidentally, when the toner 113 is pushed out from the contact portion 143, the toner 113 falls in the toner guide space 131 so as to be returned to the toner container 101 directly or by the guidance of the toner guide surface 129.

Figure 3A:
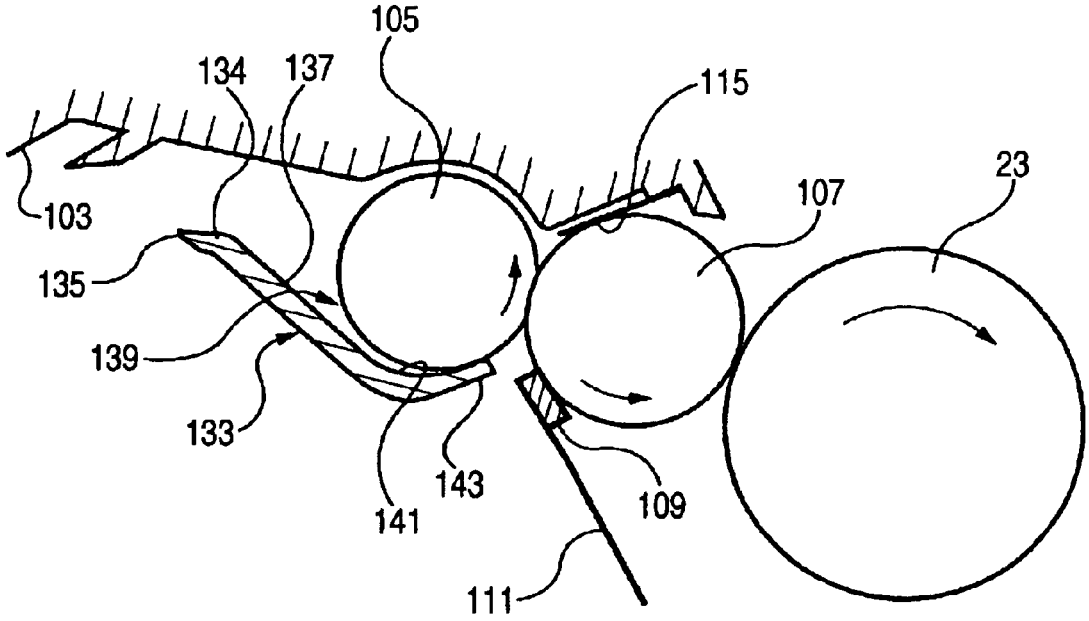
FIG. 3A is a side sectional view showing circumstance near a toner guide member of the developing device in FIG. 2.
Figure 3B:
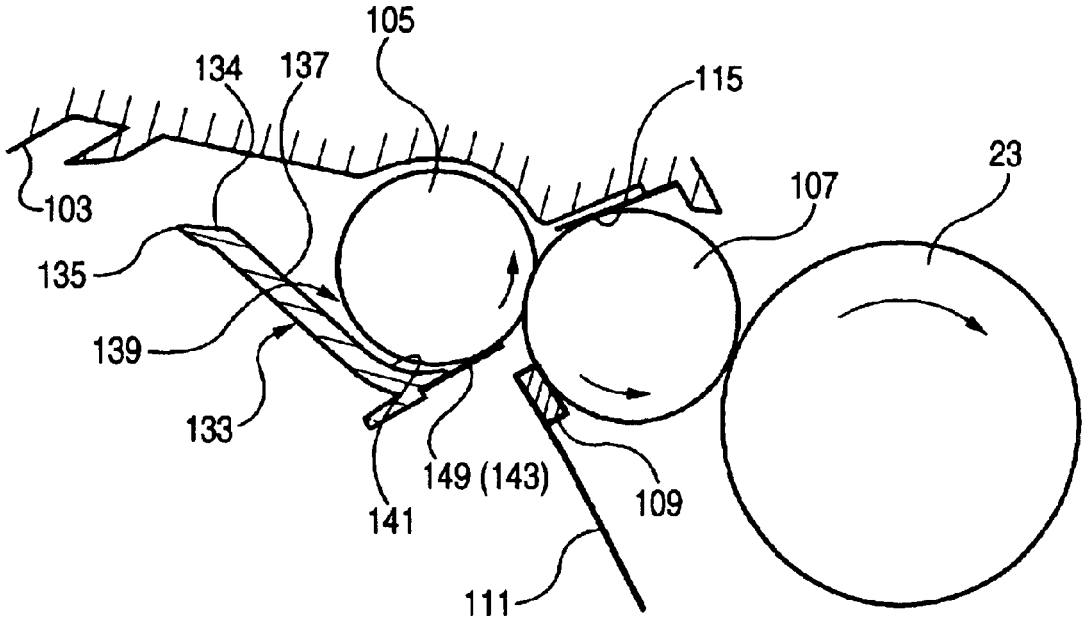
FIG. 3B is a side sectional view showing a modified example of the toner guide member in FIG. 3A.

Although the contact portion 143 is formed integrally with the toner guide member 133 in the embodiment shown in FIGS. 2 and 3A, the contact portion 143 may be formed out of a contact sheet 149 which has elasticity and which is provided as a separate member as shown in FIG. 3B, so that the contact sheet 149 is brought into pressure contact with the circumferential surface of the supply roller 105.

Here, dimensions and specifications of the respective essential members will be shown by way of example. In the embodiment, a supply roller having an electric resistance of $10^5$–$10^6$ Ω·cm and an Asker-F hardness of 60–70 degrees is used as the supply roller 105. The supply roller 105 is made of urethane foam having a plurality of cells, which has a standard cell diameter of 300–400 μm and a thickness of 24 mm. An elastic layer is formed in the outer circumferential portion of the supply roller so that the supply roller is 15–18 mm in diameter and 297 mm in length. In addition, the gap between the supply roller 105 and the inner surface of the housing 103 above the supply roller 105 is kept about 0.5–1.5 mm. The distance between the upper portion of the temporal toner storage 139 and the inner surface of the housing 103, that is, the height of the portion where the toner is thrown is 6 mm.

In addition, the width of the agitator 119 is 330 mm, and the width of the scraper 135 of the toner guide member 133 is 300 mm. As for the regulation blade 109, conductive urethane rubber about 2 mm thick is pasted to the forward end of a phosphor bronze plate or a stainless steel plate about 0.15 mm thick. Further, a PET film about 0.1–0.2 mm thick is used for the agitating fins 123. As the toner 113, polymerized toner having an average particle size of 7 μm and a negative electrostatic property is used. The toner 113 had a circularity of 0.95–0.97 superior in fluidity.

Incidentally, the dimensions, the circularity of toner, and so on, are shown here by way of example, but not intended to limit the invention. Needless to say, the invention includes other embodiments in which the dimensions and so on are changed suitably without departing from the concept of the invention.

Here, description will be made on the circularity of toner, One-component nonmagnetic toner is obtained in a grinding method or a polymerizing method. Ground toner is produced as follows. That is, a pigment, a release agent and a charge control agent are mixed into a resin binder uniformly by a Henschel mixer, and then melt and kneaded by a biaxial extruder. The mixture is cooled, then passed through a rough grinding step and a fine grinding step, subjected to a classification step, and further added with a fluidity modifier. The ground toner suitable for use in the invention may be spheroidized in order to improve the transfer efficiency. To that end, when a machine capable of grinding into relatively round spheres, for example, Turbomill (manufactured by Kawasaki Heavy Industries, Ltd.) known as a mechanical grinding machine is used in the grinding step, the circularity of toner can be obtained up to 0.93. Further, when a commercially available hot-air spheroidizer "Surfusing System SFS-3 Model" (manufactured by Nippon Pneumatic Mfg. Co., Ltd.) is used for the ground toner, the circularity of the toner can be increased up to 1.00.

On the other hand, as the method for producing polymerized toner, there are a suspension polymerization method, an emulsion polymerization method, and so on. In the suspension polymerization method, polymerizable monomer, a coloring pigment and a release agent are compounded in accordance with necessity, and further added with dyestuffs, polymerization initiator, crosslinker, a charge control agent and other additives. A monomer composition in which such a mixture has been dissolved or dispersed is added to an aqueous phase containing a suspension stabilizer (water-soluble polymer, or water-insoluble inorganic substance) while being stirred to be thereby granulated and polymerized. Thus, colored polymerized toner particles having a desired particle size can be formed.

As for the method for adjusting the circularity of the polymerized toner, the circularity can be changed desirably in the emulsion polymerization method by controlling the temperature and the time in the step of aggregating secondary particles. The adjustable range of the circularity is 0.94–1.00. On the other hand, truly spherical toner can be produced in the suspension polymerization method. The range of the circularity is 0.98–1.00. In addition, when the toner is heated and transformed at a temperature higher than the glass transition point Tg of the toner in order to adjust the circularity of the toner, the circularity can be adjusted desirably in a range of from 0.94 to 0.98. Incidentally, the average particle size and the circularity of toner particles and so on shown in this embodiment are values measured by FPIA-2100 (manufactured by Sysmex Corp.)

In addition, a work function $\psi_{SR}$ of the supply roller 105 is designed to have a relationship to a work function $\psi_a$ of the portion of the temporal toner storage 139 abutting against the supply roller 105 and a work function $\psi_t$ of the toner 113 as follows:

$$\psi_t \geqq \psi_{SR}$$

$$\psi_t \geqq \psi_a$$

Any work function (ψ) is measured by a surface analyzer AC-2 (manufactured by Riken Keiki Co., Ltd.) with a light amount of irradiation of 500 nW. The work function represents energy required for extracting an electron from a substance in question. As a substance has a smaller work function, the substance releases electrons more easily. On the contrary, as a substance has a larger work function, the substance is more difficult to release electrons. Therefore, when a substance having a small work function abuts against a substance having a large work function, the substance having a small work function is charged positively while the substance having a large work function is charged negatively. The work function of any substance itself is measured numerically as energy (eV) for extracting an electron from the substance.

Figure 4:
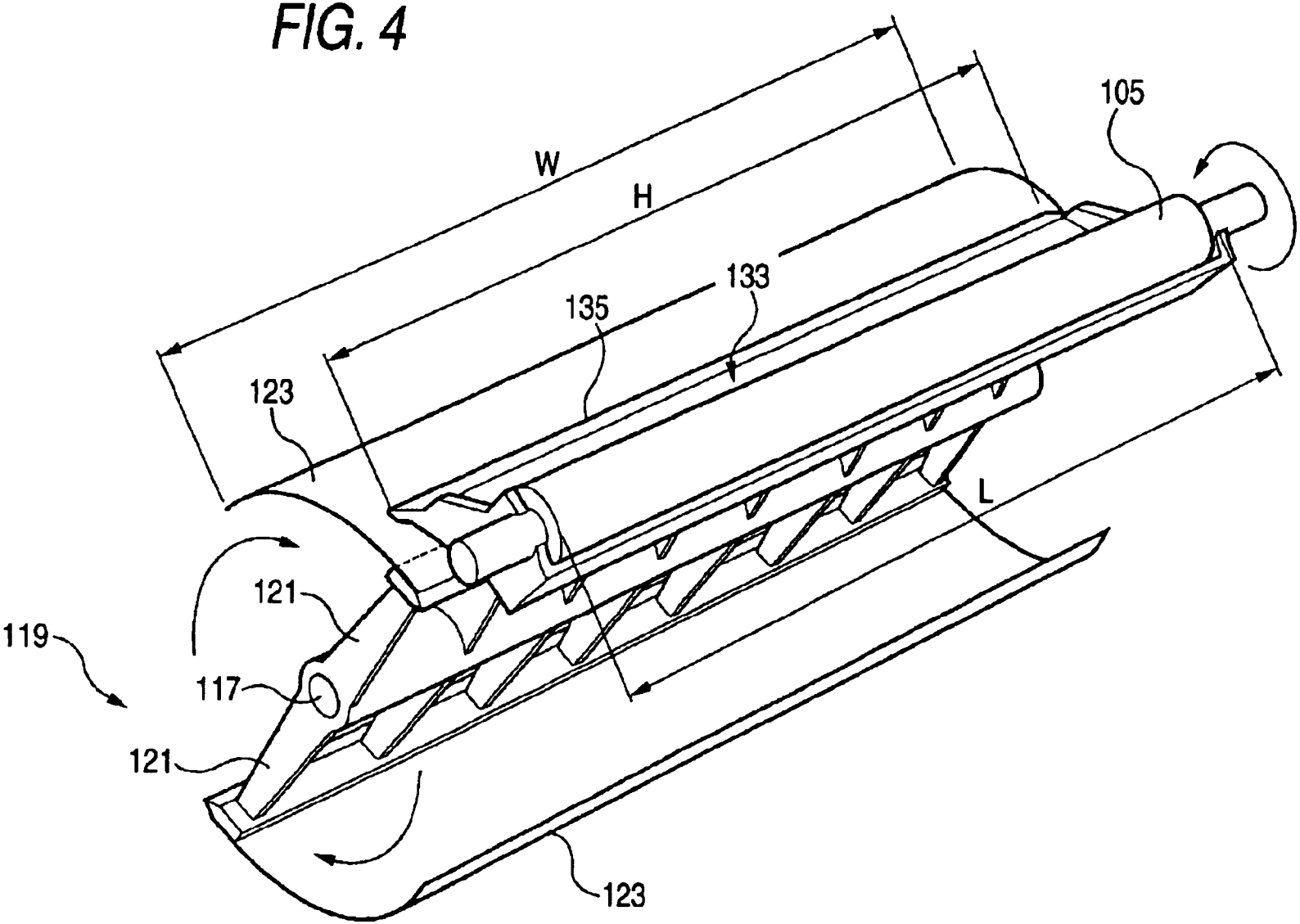
FIG. 4 is a perspective view showing circumstances of agitating fins, a toner guide member and a supply roller in the developing device in FIG. 2.

Next, description will be made on the relationship among the width W of each agitating fin 123 of the agitator 119, the entrance width H in the scraper 135 and the width L of the supply roller 105. As shown in FIG. 4, the width W of the agitating fin 123 is not less than the entrance width H in the scraper 135. In addition, the entrance width H in the scraper 135 is preferably not less the width L of the supply roller. These widths are expressed as follows.

$$W \geqq H(\geqq L)$$

Here, "(≧L)" means that the relationship "H≧L" is not necessarily satisfied so long as the relationship "W≧H" is satisfied, but the relationship "H≧L" may be satisfied in a preferred embodiment.

When the width W of the agitating fin 123 is not less than the entrance width H in the scraper 135, of the toner 113 placed all over the width of the agitating fin 123, only the toner 113 in a range corresponding to the entrance width H of the toner guide member 133 is scraped from the agitating fin 123 as shown in FIG. 4. Thus, in the portion of the entrance width H, a constant volume of the toner 113 is always present over the lengthwise range of the portion. Accordingly, a constant volume of the toner 113 can be supplied uniformly over the lengthwise range of the supply roller 105. It is therefore possible to attain a print having no variation in toner density in the width direction of paper which is a printing object.

In addition, when the width W of the agitating fin 123 is not less than the entrance width H, it is possible to surely avoid the situation that the toner 113 is not supplied to the both side end portions of the portion having the entrance width H in the toner guide member 133. Also in this point, a print having no variation in toner density in the width direction of paper is guaranteed.

In addition, when the condition "H≧L" is satisfied in the state where the condition "W≧H" is satisfied, a constant volume of the toner 113 is always present in the portion having the entrance width H in the toner guide member 133 as described above. Thus, a uniform volume of the toner 113 is also supplied all over the width of the supply roller 105 having a width less than the entrance width H. It is therefore possible to surely perform printing with no variation in toner density in the width direction of paper.

Figure 5A:
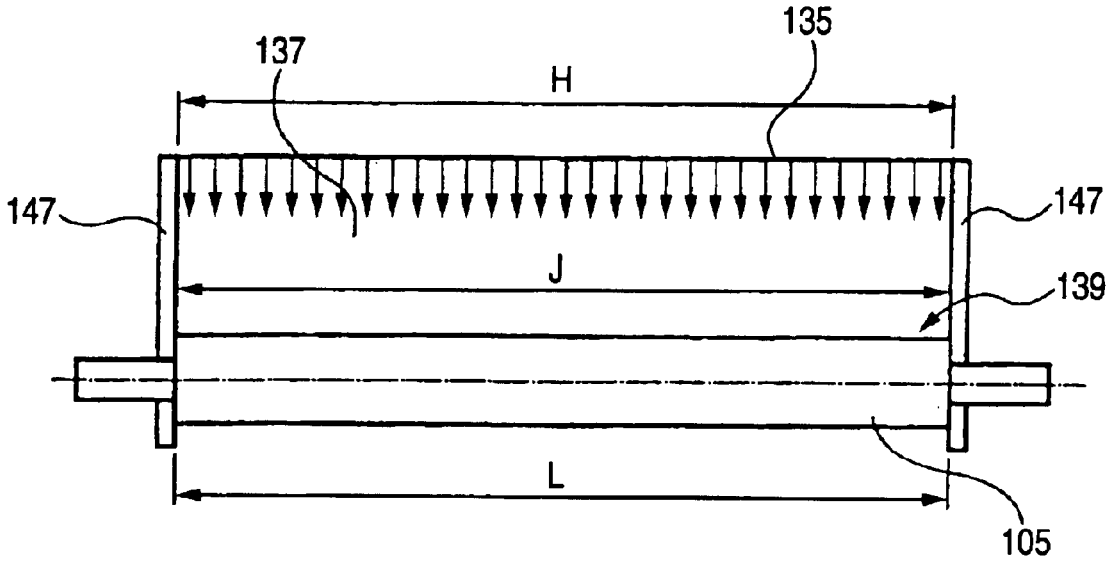
FIGS. 5A and 5B are schematic views showing examples of the toner guide member.
Figure 5B:
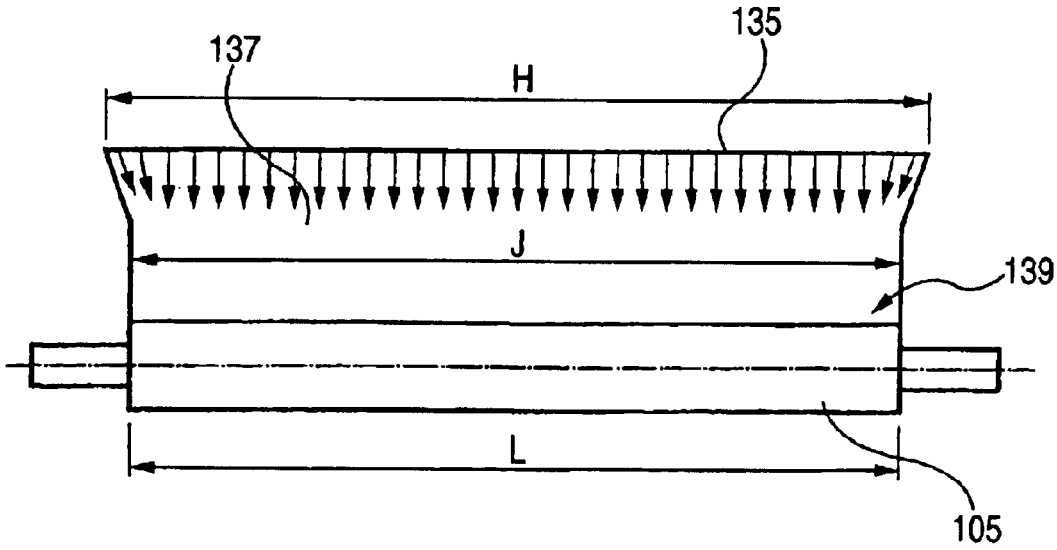

Next, description will be made on the width of the portion where the toner is moved from the flat conveying portion 137 to the temporary storage portion 139, that is, the relationship between the toner introduction width J to the temporary storage portion 139 and the width L of the supply roller 105. FIGS. 5A and 5B schematically show the relationship between the toner introduction width J and the width L of the supply roller 105. In each of these figures, the toner introduction width J and the width L of the supply roller 105 match each other in position and have lengths equal to each other. In FIG. 5A, the entrance width H is set to be equal to the toner introduction width J. In FIG. 5B, the entrance width H is set to be larger than the toner introduction width J.

As shown in FIGS. 5A and 5B, when the toner introduction width J is equal to the width L of the supply roller 105, the toner 113 stored temporarily in the temporary storage portion 139 moves in parallel directly to the supply roller 105 all over the widthwise range of the temporary storage portion 139 so that the toner 113 can be carried on the circumferential surface of the supply roller 105. Accordingly, the toner 113 stored in the temporary storage portion 139 is carried on the supply roller 105 in just proportion over the widthwise range of the temporary storage portion 139 so that a uniform volume of the toner 113 can be carried over the widthwise range of the supply roller 105. Thus, it is possible to attain a print producing no variation in toner density in the width direction of paper.

In FIG. 5A, between the scraper 135 and the circumference of the rotating shaft of the supply roller 105, side walls 147 are formed into straight lines and at right angles with the rotating shaft of the supply roller 105. The side walls 147 formed thus can prevent the toner 113 from being leaked to be conveyed sideways when the toner 113 is conveyed from the scraper 135 to the supply roller 105 through the flat conveying portion 137. In addition, as shown in FIG. 5A, the opposite end portions of the supply roller 105 are sealed with the seal side walls 147 so that the toner is prevented from being exteriorly leaked out of the effective length of the supply roller 105.

On the other hand, in FIG. 5B, the entrance width H is set to be larger than the toner introduction width J. Accordingly, as shown by the arrows in FIG. 5B, the toner 113 located on the portions of the entrance width H out of the toner introduction width J (toner existing near the opposite ends of the scraper 135) is gathered inward. However, since the toner 113 is stored temporarily in the temporary storage portion 139, practically, there is no probability that the toner volume increases only in the opposite ends of the introduction width J. Thus, it is possible to attain a print producing no variation in toner density in the width direction of paper in the same manner as in the configuration of FIG. 5A.

In the configurations shown in FIGS. 5A and 5B, it is more preferable that the width L of the supply roller 105 is substantially equal to the paper width (not shown). In this case, all the toner carried on the supply roller 105 is used effectively so that printing is performed on the paper side with the toner on the supply roller 105 in just proportion.

Next, description will be made on a shutter structure for preventing the toner 113 conveyed by the agitating fin 123 from being accepted onto the toner guide member 133, with reference to FIGS. 2, 6 and 7A to 7D.

As described above, the toner 113 on the toner guide member 133 falls freely on the toner guide member 133 and then stays in the temporal toner storage 139. When the supply roller 105 rotates, the toner 113 is carried on the circumferential surface thereof and consumed. However, in a case that low duty printing is performed in accordance with the kind of paper to print on or the design to print, toner is supplied excessively to the toner guide member 133 by the agitating fins 123. In this case, it is therefore necessary to suspend the toner supply to the toner guide member 133 by the agitating fins 123. To this end, the shutter structure which will be described below is provided near the scraper 135 of the toner guide member 133.

Figure 6:
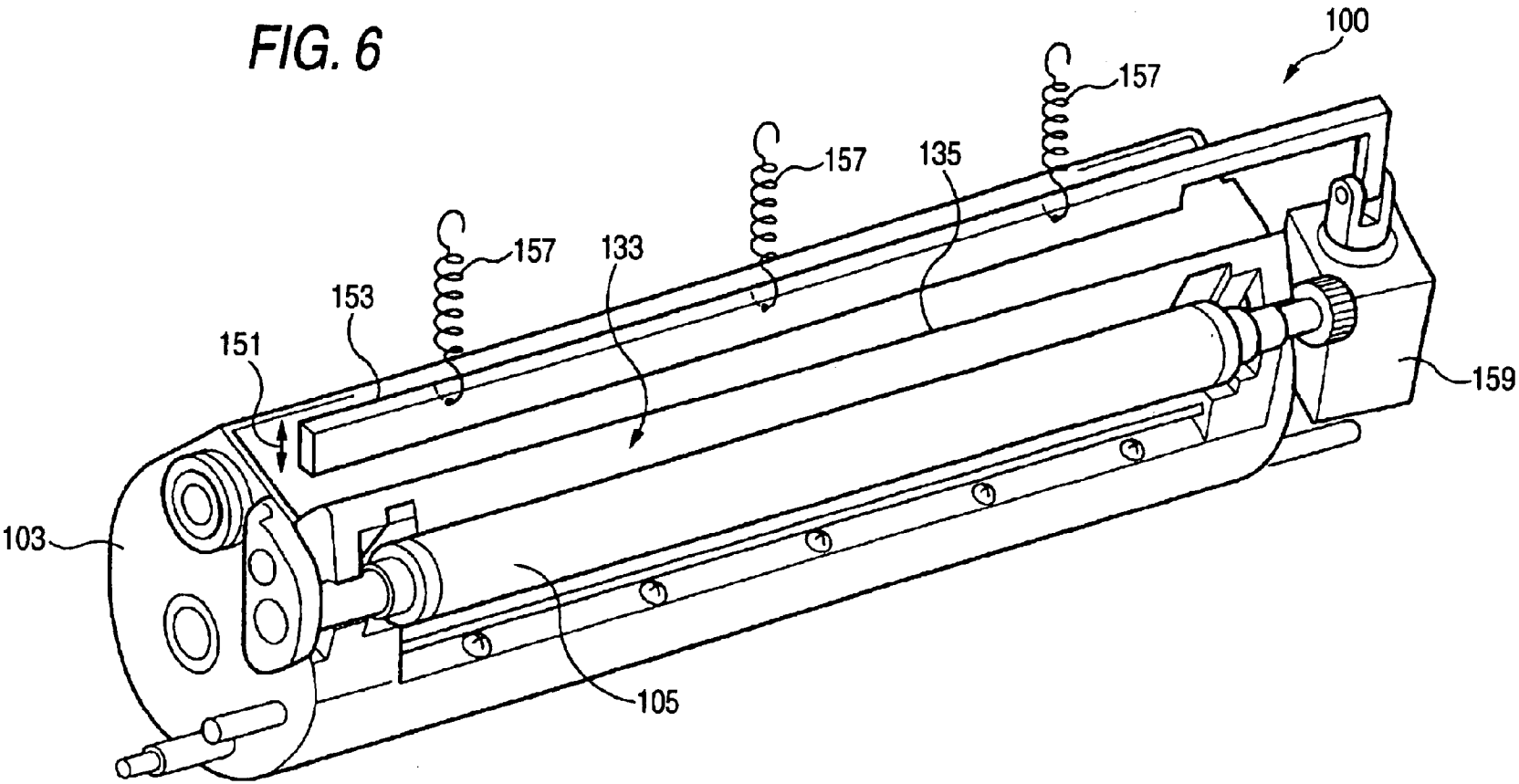
FIG. 6 is a perspective view showing the vicinity of a shutter member in the developing device in FIG. 2.
Figure 7A:
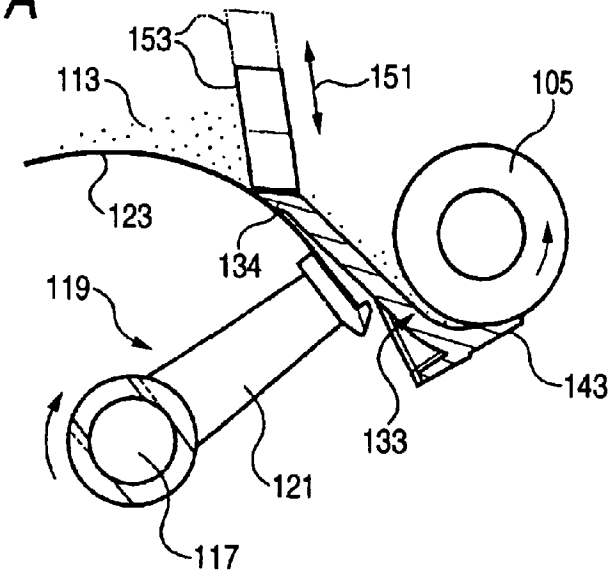
FIGS. 7A to 7D are schematic views showing examples of the shutter member.

That is, in the embodiment shown in FIG. 2, a shutter member 153 which can get close to and away from an end portion 134 of the toner guide member 133 as shown by arrows 151 is provided above the end portion 134 as shown in detail in FIGS. 6 and 7A. The shutter member 153 is always urged to get away from the end portion 134 by coil springs 157. On the other hand, when a monitoring sensor 155 (see FIG. 2) facing the temporal toner storage 139 detects that the volume of the toner 113 stored in the temporal toner storage 139 has reached a predetermined value or more, a solenoid valve 159 (see FIG. 6) is actuated to bring the shutter member 153 into pressure contact with the end portion 134 of the toner guide member 133. Incidentally, instead of the monitoring sensor 155, the shutter member 153 may be designed to abut against the end portion 134 in the mode of low duty printing so as to suspend the toner supply temporarily.

Figure 7B:
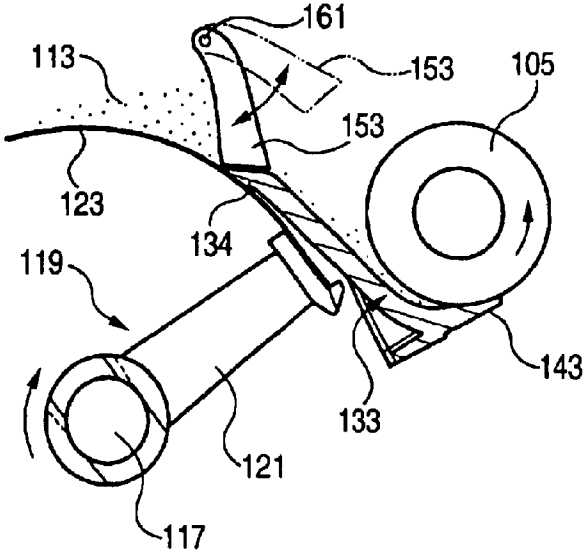
Figure 7C:
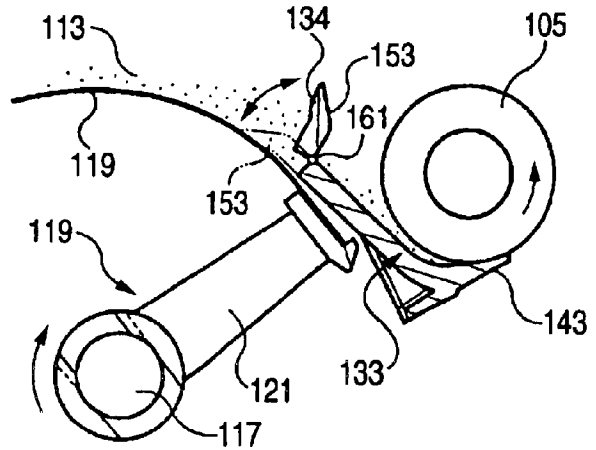
Figure 7D:
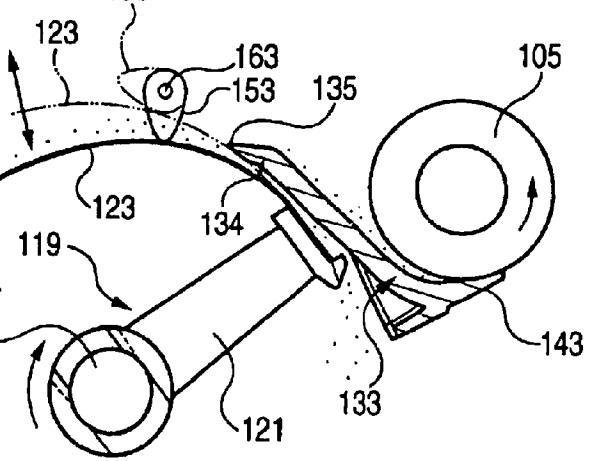

FIGS. 7B to 7D show other examples of shutter members 153 for suspending toner supply to the toner guide member 133. In the embodiment shown in FIG. 7B, the shutter member 153 is designed to be able to rotate around a rotation fulcrum 161. In FIG. 7B, the shutter member 153 operates to suspend the toner supply to the toner guide member 133 when the shutter member 153 is located in a position shown by the solid line. On the other hand, when the shutter member 153 is located in a position shown by the imaginary line, the shutter member 153 allows the toner to be supplied to the toner guide member 133.

In addition, in the embodiment shown in FIG. 7C, a rotation fulcrum 161 is formed on the downstream side of the end portion 134 of the toner guide member 133 in the toner conveying direction. The portion on the forward end side of the rotation fulcrum 161 serves as a shutter member 153. That is, in FIG. 7C, the shutter member 153 operates to suspend the toner supply to the toner guide member 133 when the shutter member 153 is located in a position shown by the solid line. On the other hand, when the shutter member 153 is located in a position shown by the imaginary line, the shutter member 153 allows the toner to be supplied to the toner guide member 133. Incidentally, the rotation fulcrum 161 is substantially on the same plane as the surface of the flat conveying portion 137 so as not to impede the smooth conveyance of the toner.

Further, in the embodiment shown in FIG. 7D, a shutter member 153 which can rotate around a rotating shaft 163 is provided to serve as a cam in contact with the upper surface side of the agitating fin 123. In this embodiment, as shown by the solid line in FIG. 7D, when the shutter member 153 operates to push the agitating fin 123 down by its cam function, the agitating fin 123 is elastically deformed to get away from the scraper 135. Thus, the toner supply to the toner guide member 133 can be suspended. On the other hand, when the shutter member 153 rotates as shown by the imaginary line, the agitating fin 123 abuts against the scraper 135. Thus, the toner supply to the toner guide member 133 is allowed.

Next, description will be made on the circulation of the toner in the developing device according to this embodiment. Of the toner 113 received in the toner container 101, the toner 113 existing in the area 125 between the inner circumferential surface of the toner container 101 and the agitating fin 123 is scooped up by the agitating fin 123 by the rotation action of the agitator 119. The scooped toner 113 is scraped by the scraper 135. The toner 113 scraped by the scraper 135 falls sliding on the flat conveying portion 137 so as to reach the temporal toner storage 139.

The toner 113 stored in the temporal toner storage 139 is successively carried on the circumferential surface of the supply roller 105. After that, the toner is moved to the developing roller 107. Then, excess toner is scraped by the regulation blade 109 while the toner carried by the developing roller 107 is charged by the regulation blade 109 so as to develop an electrostatic latent image formed on the photoconductor drum 23.

The toner 113 scraped by the regulation blade 109 falls in the toner guide space 131 by gravitation so as to be returned to the toner container 101 directly or after sliding down on the toner guide surface 129.

Figure 8:
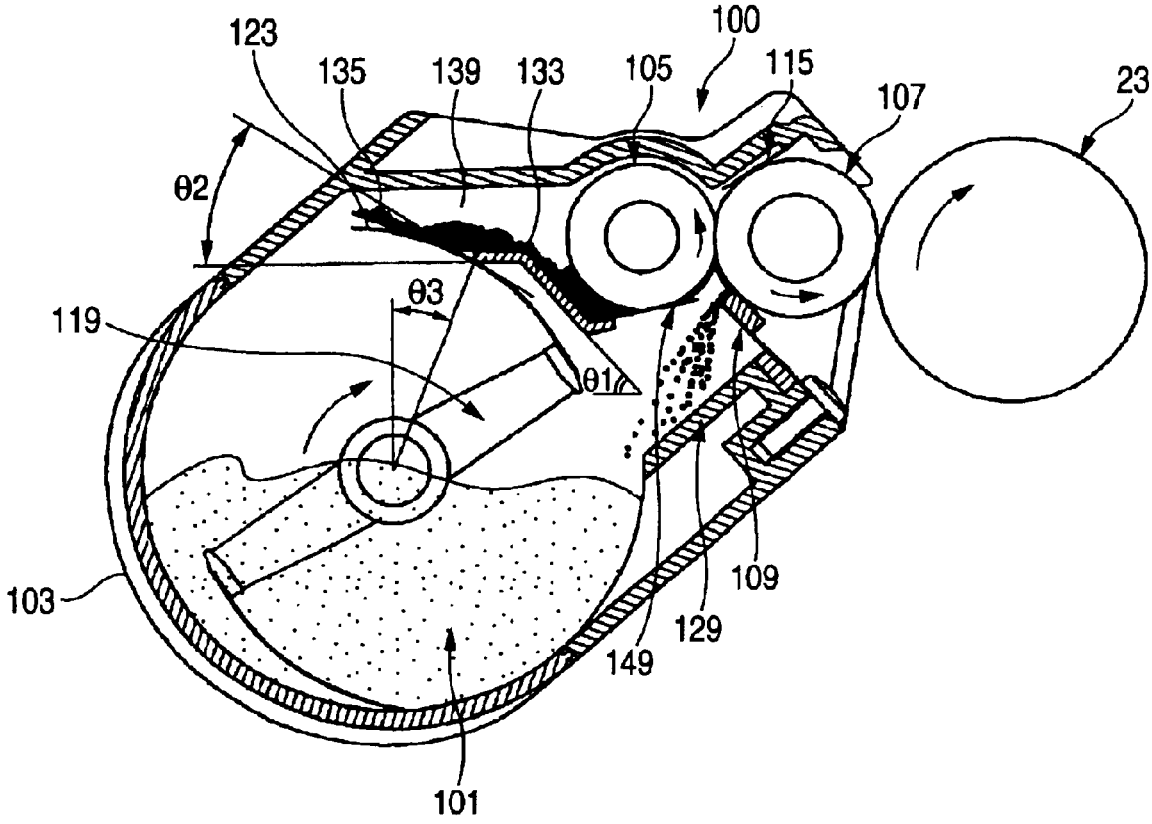
FIG. 8 is a side sectional view showing a developing device according to a second embodiment of the invention.

Next, a developing device according to a second embodiment will be described with reference to FIG. 8. In this figure, components similar to those in the first embodiment will be designated by the same reference numerals.

A developing device 100 is constituted by a container housing 103 for storing toner (meshed portion); a toner container 101 formed in the container housing 103; an agitator 119 disposed in the toner container 101; a toner guide member 133 provided above the toner container 101; a supply roller 105 disposed above the toner guide member 133; a contact sheet 149 provided on the toner guide member 133 so as to abut against the lower portion of the supply roller 105; a developing roller 107 provided to abut against the supply roller 105 and face a photoconductor drum 23 through a slight distance (about 100–300 $\mu$m); a regulation blade 109 abutting against a lower part of the developing roller 107; a toner guide surface 129 on which the regulation blade 109 is provided and which serves a toner guide path for allowing the toner controlled by the regulation blade 109 to fall on the toner guide path so as to fall freely to the toner container 101; and a seal member 115 for preventing toner leakage while abutting against the developing roller 107 in a direction to recover the toner staying on the developing roller 107 after development.

The developing roller 107 and the photoconductor drum 23 face each other through a slight distance. The developing roller 107 and the photoconductor drum 23 are driven to rotate in reverse directions to each other as shown by the arrows in FIG. 8. In a developing area where the developing roller 107 and the photoconductor drum 23 face each other, the circumferential surfaces of the developing roller 107 and the photoconductor drum 23 move upward in the same direction. A developing bias in which an AC voltage is superimposed on a DC voltage is applied from a developing bias source (not shown) to the developing roller 107 so as to make an oscillating electric field act between the developing roller 107 and the photoconductor drum 23. Thus, toner is supplied from the developing roller to an electrostatic latent image portion formed in the photoconductor, so as to perform development. Incidentally, in this embodiment, the developing roller 107 and the photoconductor drum 23 are designed to face each other through a slight distance in the developing area. However, development may be carried out with the developing roller and the photoconductor in contact with each other in the developing area.

In this embodiment, toner limited not to bury the regulation blade 109 is received in the toner container 101 for the following reasons. That is, if the toner volume were large enough to bury the regulation blade 109, the circulating path for returning the toner scraped by the regulation blade 109 to the toner container 101 smoothly would be blocked. In addition, the role of the regulation blade 109 to scrape excess toner out of the toner on the developing roller 107 to thereby control the volume of toner conveyed to the developing area would be blocked while the role of the regulation blade 109 to charge the toner properly would be blocked. Further, the agitator 119 having flexible agitating fins 123 attached to both end portions thereof is rotatably provided in the toner container 101. Incidentally, a large number of slits are formed in the agitating fins 123. Then, by rotating the agitator 119, the toner received in the toner container 101 is supplied to a temporal toner storage 139 between the toner guide member 133 and the supply roller 105 by the agitating fins 123 attached to the agitator 119.

The supply roller 105 having a conductive elastic layer with a plurality of cells provided in its outer circumferential portion is disposed closely to the temporal toner storage 139. The elastic layer of the supply roller 105 is brought into pressure contact with the developing roller 107. The supply roller 105 and the developing roller 107 are rotated in the same direction so that their circumferential surfaces are moved in reverse directions in their contact area and rubbed against each other. Thus, a voltage equal to the developing bias voltage applied from the developing bias source (not shown) to the developing roller is applied to the supply roller.

One end of the contact sheet 149 formed into a sheet is attached to the toner guide member 133 while the contact sheet 149 is brought into contact with a lower part of the supply roller 105 with a proper linear pressure. By the presence of this contact sheet 149, the toner adhering to the supply roller 105 is prevented from falling down from the lower position of the supply roller 105 by gravitation. Thus, the toner that can be supplied to the developing roller 107 is prevented from being reduced, so that the image density is prevented from being lowered.

Of the toner supplied from the supply roller 105 to the developing roller 107, excess toner is scraped from the developing roller by the regulation blade 109 so that the volume of toner to be conveyed to the developing area is controlled while the toner is charged properly. Incidentally, some of the excess toner scraped from the developing roller 107 by the regulation blade 109 falls onto the toner guide surface 129 under the regulation blade 109 by gravitation, and then slips from this wall. Thus, the toner is returned to the toner container 101. The other of the excess toner falls directly to the toner container 101 so as to be returned thereto. At this time, the angle of the toner guide surface 129 with the horizontal line is set to be larger than the repose angle of the toner. Then, the toner controlled by the regulation blade 109 and charged properly is conveyed to the developing area where the developing roller 107 and the photoconductor drum 23 face each other by the developing roller 107 so as to develop an electrostatic latent image portion on the photoconductor drum 23 by the effect of the oscillating electric field.

After the electrostatic latent image formed on the photoconductor drum 23 is developed thus, the seal member 115 is brought into slight contact with the developing roller 107 in a position where the toner staying on the developing roller 107 is to be returned the inside. Thus, leakage of the toner is prevented. After the development, the toner staying on the surface of the developing roller 107 is removed by the rubbing between the developing roller 107 and the supply roller 105. Thus, the removed toner is mixed with the collected toner in the temporal toner storage 139 between the toner guide member 133 and the supply roller 105, and then supplied from the supply roller 105 to the developing roller 107 as recycled toner.

Here, dimensions and specifications of the respective essential members will be shown by way of example. In this embodiment, the photoconductor drum 23 is 30 mm in diameter and the developing roller 107 is 18 mm in diameter. The photoconductor drum 23 is rotated at a peripheral velocity of about 100–200 mm/s while the peripheral velocity of the developing roller 107 is set to be about 1.5–2 times as high as the peripheral velocity of the photoconductor drum 23. The supply roller 105 has an electric resistance of $10^{5-106}$ Ω·cm and an Asker-F hardness of 60–70 degrees. The supply roller 105 is made of urethane foam having a plurality of cells, which has a standard cell diameter of 100–150 μm and a thickness of 2–4 mm. An elastic layer is formed in the outer circumferential portion of the supply roller 105 so that the diameter of the supply roller 105 is 15–18 mm. As for the regulation blade 109, conductive urethane rubber about 2 mm thick is pasted to the tip end of a phosphor bronze plate or a stainless steel plate about 0.15 mm thick. In addition, a PET film about 0.1–0.2 mm thick is used for the contact sheet 149 and the agitating fins 123.

According to the configuration, when the toner scraped by the regulation blade 109 is recovered in the toner container 101, stress applied to the toner is eliminated by recovering the toner using its gravitation or its repose angle. As a result, the lifetime of the toner can be prolonged. Accordingly, a stain on the white background of print or a change of density caused by fogging of toner or lowering of charge quantity of toner can be reduced so that good image quality can be kept. In addition, the toner consumption is reduced so that the running cost can be reduced.

In the toner container 101, the center of the supply roller 105 is higher than the top surface of a toner deposit, and a scraper 135 (sheet of PET about 0.15 mm thick) is pasted to the leading end portion of the toner guide member 133 under the supply roller. The toner shown in black in FIG. 8 is shown in the state where the toner has been conveyed onto the scraper 135. The scraper 135 is set as follows. That is, the agitating fin 123 attached to the tip end of the agitator 119 approaches the leading end of the scraper 135 and abuts against the scraper 135. Thus, the scraper 135 is pushed and deformed upward by the agitating fin 123. Then, the toner conveyed by the agitating fin 123 is delivered to the scraper 135. After that, the scraper 135 is deformed upward so that the toner moves to the temporal toner storage 139 between the toner guide member 133 and the supply roller 105.

Incidentally, it is desired that the angle of the scraper 135 with the horizontal line is not smaller than the repose angle of the toner in the state where the scraper 135 has been attached to the toner guide member 133. However, the angle of the scraper 135 may be not larger than the repose angle of the toner. In that case, the toner may indeed stay on the scraper 135 without moving to the temporal toner storage 139, but the scraper 135 is deformed upward as described above after the agitating fin 123 abuts against the scraper 135. Thus, in this state, the angle of the scraper 135 becomes not smaller than the repose angle so that the toner moves to the temporal toner storage 139.

Each of the scraper 135 and the agitating fin 123 is made of a resin sheet. Thus, both the scraper 135 and the agitating fin 123 have a property easy to bend in response to stress. For suitable use of the scraper 135 and the agitating fin 123, it is desired that the scraper 135 has a property easier to bend than the agitating fin 123. To that end, it is desired that the scraper 135 is made thinner when the scraper 135 and the agitating fin 123 are made of the same material, and the rigidity of the scraper 135 is set to be lower when the scraper 135 and the agitating fin 123 are made of different materials. Thus, after sufficient toner is delivered from the agitating fin 123 to the scraper 135, the scraper 135 is deformed to supply the toner to the temporal toner storage 139 promptly.

On the other hand, in a section in the direction of the roller axis, assume that a tangent to the agitating fin 123 at the place where the agitating fin 123 first abuts against the toner guide member 133 is at an angle θ2 with the horizontal line, and the toner guide member 133 is at an angle θ1 with the horizontal line. Then, it is preferable that the relationship $\theta 1 > \theta 2$ is established. If the relationship $\theta 1 < \theta 2$ were satisfied, the angle of approach $(90° - \theta 2)$ of the agitating fin 123 at which the agitating fin 123 abuts against the scraper 135 would be large so as to cause problems, that is, to block smooth deformation of the scraper 135, to place an excessive load on the agitating fin 123 to thereby shorten the lifetime of the agitating fin 123, or to increase torque required for rotating the agitator 119 to which the agitating fin 123 is fixed. Further, it can be considered that much noise is generated at the moment the agitating fin 123 abuts against the scraper 135. It is therefore preferable that the relationship $\theta 1 > \theta 2$ is satisfied.

In addition, assume that a line segment connecting the place where the agitating fin 123 first abuts against the toner guide member 133 with the rotation center of the agitator 119 to which the agitating fin 123 is fixed is at an angle θ3 with the vertical line. When the rotation direction of the agitator 119 is regarded as positive, it is preferable that the relationship $0 \leqq \theta 3$ is established. If the relationship $\theta 3 < 0$ were established, it would be conceived that the toner at the tip end of the agitating fin 123 might fall down from the agitating fin 123 or the scraper 135 so that sufficient toner might not be supplied to the temporal toner storage 139 efficiently. Thus, there might occur a short supply of toner, resulting in lowering of image density. From the above description, good toner supply can be attained by setting proper arrangement or rigidity of the agitating fin 123 and the scraper 135.

Figure 9:
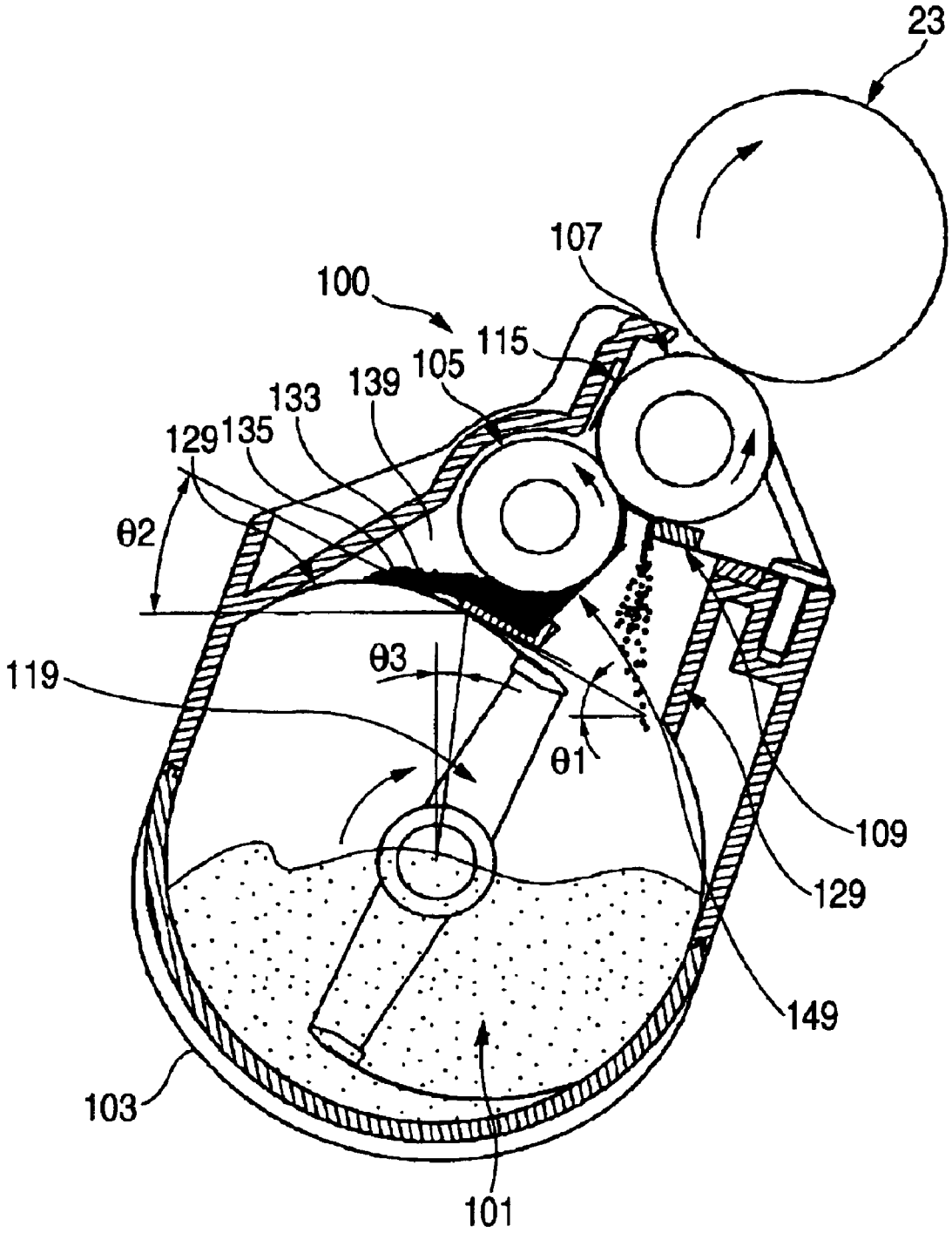
FIG. 9 is a side sectional view showing a developing device according to a third embodiment of the invention.
Figure 10:
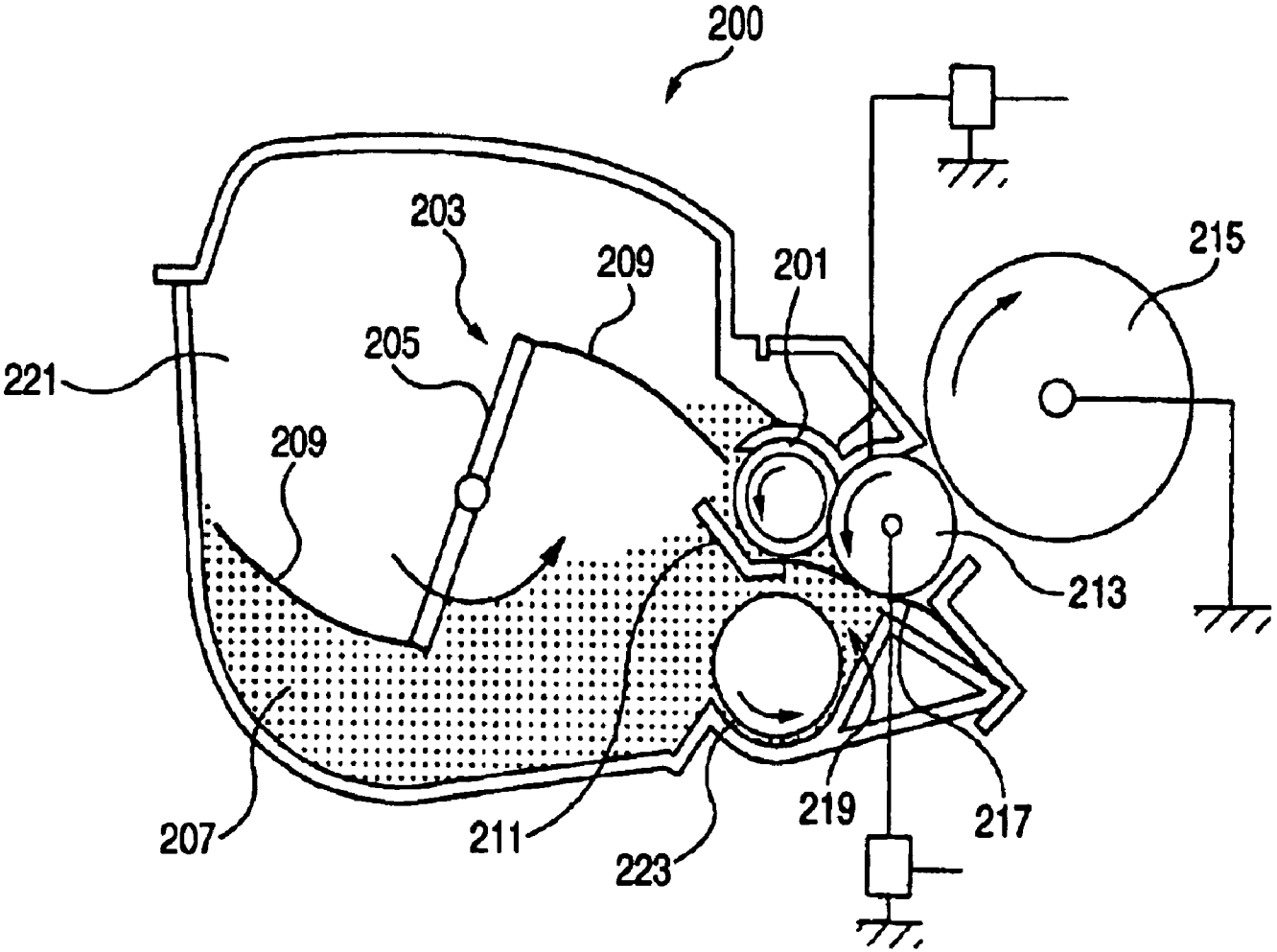
FIG. 10 is a side sectional view showing a related-art developing device.

FIG. 9 shows a third embodiment of the invention. This embodiment has a feature in that a developing roller 107 is disposed under a photoconductor drum 23. The other things are quite the same as those in the second embodiment, and their detailed description will be therefore omitted. Also in this embodiment, when the toner scraped by the regulation blade 109 is recovered in the toner container 101, stress applied to the toner is eliminated by recovering the toner using its gravitation or its repose angle. As a result, the lifetime of the toner can be prolonged. Accordingly, a stain on the white background of print or a change of density caused by fogging of toner or lowering of charge quantity of toner can be reduced so that good image quality can be kept. In addition, the toner consumption is also reduced so that the running cost can be reduced.

In addition, good toner supply can be attained by setting proper arrangement or rigidity of the agitating fin 123 and the scraper 135.

In each of the above described developing devices 100, portions 100*a* at which the developing rollers 107 are exposed is formed as shown in FIG. 1. On the other hand, a gap 25*a* is formed in each corona charger 25 so as to face an associated photoconductive drum 23. At this time, if the gap 25*a* of the corona charger 25 were located under the portion 100*a*, there would occur a problem as follows. That is, toner would fall down from the portion 100*a* by gravitation, and enter the corona charger 25 through the gap 25*a* of the corona charger 25. Thus, the corona charger 25 would be contaminated with the toner.

In this embodiment, therefore, the gap 25*a* of the corona charger 25 is made offset toward the intermediate transfer belt 33 so that the gap 25*a* does not overlap the portion 100*a* of the developing device 100. Consequently, it is possible to solve the problem that toner falling down from the portion 100*a* by gravitation enters the corona charger 25 through the gap 25*a* so that the corona charger 25 is contaminated with the toner.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A developing device, comprising:

a carrier, which carries developer;

a supplier, which supplies the developer to the carrier;

a transporter, which transports the developer to the supplier; and a receiver, to which the transporter is brought into contact when the transporter transports the developer to the supplier, the receiver disposed below the supplier, wherein:

the transporter is rotatably provided, the receiver is angled from a horizontal line by a first angle; and a tangent line between the transporter and the receiver at a first portion at which the transporter is first brought into contact with the receiver is angled from a horizontal line by a second angle which is smaller than the first angle, and the developer is transported to the supplier from the first portion.

2. A developing device, comprising:

a carrier, which carries developer;

a supplier, which supplies the developer to the carrier;

a transporter, which transports the developer to the supplier;

a receiver, to which the transporter is brought into contact when the transporter transports the developer to the supplier, the receiver disposed below the supplier; and a first container, disposed below the carrier to contain the developer therein, wherein the transporter is rotatably disposed in the first container such that the developer is transported to the receiver along an inner wall face of the first container, and wherein:

the transporter has an arm member extended from a rotation center thereof and an elastic fin member provided on a distal end of the arm member to transport the developer situated between the inner wall face of the first container and the fin member, and to be brought into contact with the receiver;

a scraper is disposed at a portion in the receiver at which the fin member is brought into contact, and has a leading end for scraping off the developer transported by the fin member; and the fin member has a first width along a rotation axis of the transporter, and the leading end of the scraper has a second width smaller than the first width.

3. The developing device as set forth in claim 2, wherein the supplier is rotatable about a rotation axis, and has a third width along the rotation axis, which is smaller than the second width.

4. A developing device, comprising:

a carrier, which carries developer;

a supplier, which supplies the developer to the carrier;

a transporter, which transports the developer to the supplier; and a receiver, to which the transporter is brought into contact when the transporter transports the developer to the supplier, the receiver disposed below the supplier, wherein:

the receiver has a slope portion facing the supplier and angled from a horizontal line by an angle not less than a repose angle of the developer;

the receiver has a curved portion continued from a lower end of the slope portion and including a portion abutted against the supplier; and a surface roughness of the slope portion and the curved portion is less than an average diameter of the developer.

5. A developing device, comprising:

a carrier, which carries developer;

a supplier, which supplies the developer to the carrier;

a transporter, which transports the developer to the supplier;

a receiver, to which the transporter is brought into contact when the transporter transports the developer to the supplier, the receiver disposed below the supplier; and a casing, which accommodates the carrier, the supplier, the transporter and the receiver, wherein the receiver has side walls at both widthwise ends thereof which are independent form the casing.

6. A developing device, comprising:

a carrier, which carries developer;

a supplier, which supplies the developer to the carrier;

a transporter, which transports the developer to the supplier;

a receiver, to which the transporter is brought into contact when the transporter transports the developer to the supplier, the receiver disposed below the supplier;

a first container, disposed below the carrier to contain the developer therein, wherein the transporter is rotatably disposed in the first container such that the developer is transported to the receiver along an inner wall face of the first container;

a regulation member, disposed at a lower portion of the carrier to control an amount of the developer carried by the carrier; and a guiding path, which guides developer dropped by the regulation member from the carrier, to the first container, wherein the guiding path is angled from a horizontal line by an angle not less than a repose angle of the developer.

7. A developing device, comprising:

a carrier, which carries developer;

a supplier, which supplies the developer to the carrier;

a transporter, which transports the developer to the supplier; and a receiver, to which the transporter is brought into contact when the transporter transports the developer to the supplier, the receiver disposed below the supplier, wherein:

the receiver includes a receiving portion for receiving the developer from the transporter, and a storage space continued from the receiving portion for temporarily storing the developer to be delivered to the supplier;

the supplier is rotatable about a rotation axis and has a first width along the rotation axis; and an entrance width of the storage space is identical with the first width.

8. A developing device, comprising:

a carrier, which carries developer;

a supplier, which supplies the developer to the carrier;

a transporter, which transports the developer to the supplier; and a receiver, to which the transporter is brought into contact when the transporter transports the developer to the supplier, the receiver disposed below the supplier, wherein:

the receiver faces the supplier to define a storage space there between for temporarily storing the developer transported, by the transporter; and the receiver includes a contact portion abutted onto the supplier so that the gap is narrowed toward the contact portion.

9. A developing device, comprising:

a carrier, which carries developer;

a supplier, which supplies the developer to the carrier;

a transporter, which transports the developer to the supplier; and a receiver, to which the transporter is brought into contact when the transporter transports the developer to the supplier, the receiver disposed below the supplier, wherein a first work function of the supplier is not greater than a second work function of the developer.

10. The developing device as set forth in claim 8, wherein a first work function of the supplier is not greater than a second work function of a portion of the receiver defining the storage space.

11. A developing device, comprising:

a carrier, which carries developer;

a supplier, which supplies the developer to the carrier;

a transporter, which transports the developer to the supplier;

a receiver, to which the transporter is brought into contact when the transporter transports the developer to the supplier, the receiver disposed below the supplier; and a shutter, disposed in the vicinity of a receiving portion at which the transporter is brought into contact, which selectively disables the reception of the developer into the receiver.

12. The developing device as set forth in claim 11, wherein the shutter approaches the receiving portion from thereabove to disable the reception of the developer.

13. The developing device as set forth in claim 11, wherein the shutter is pivotably supported above the receiving portion, so that the reception of the developer is disabled when the shutter is pivoted downward.

14. The developing device as set forth in claim 11, wherein the shutter is pivotably supported below the receiving portion, so that the reception of the developer is disabled when the shutter is pivoted upward.

15. The developing device as set forth in claim 11, wherein:

the shutter is movable between a first position and a second position;

the transporter is brought into contact with the receiver at the receiving portion when the shutter is placed at the first position; and the transporter is deformed such that the transporter is not brought into contact with the receiver when the shutter is placed at the second position.

16. The developing device as set forth in claim 11, wherein the shutter is operated in accordance with a consumption amount of the developer at an image carrier on which an image is developed.

17. The developing device as set forth in claim 11, further comprising a sensor which detects an amount of the developer stored in a storage space defined between the receiver and the supplier, wherein the shutter is operated in accordance with the amount of the developer detected by the sensor.

18. An image forming apparatus, comprising the developing device as set forth in any one of claims 1, 2, 4, 5, 6, 7, 8, 9, and 11.

* * * * *